US006968593B1

(12) United States Patent
Lenkiewicz et al.

(10) Patent No.: US 6,968,593 B1
(45) Date of Patent: Nov. 29, 2005

(54) HAND-HELD DEEP CLEANER

(75) Inventors: Kenneth M. Lenkiewicz, Grand Rapids, MI (US); Alan J. Krebs, Pierson, MI (US); Phong Hoang Tran, Caledonia, MI (US); Jonathan Miner, Rockford, MI (US); Gary A. Kasper, Grand Rapids, MI (US); Eric C. Huffman, Lowell, MI (US); Charles A. Reed, Jr., Rockford, MI (US); Eric J. Hansen, Ada, MI (US)

(73) Assignee: Bissell Homecare, Inc., Grand Rapids, MI (US)

( * ) Notice: Subject to any disclaimer, the term of this patent is extended or adjusted under 35 U.S.C. 154(b) by 432 days.

(21) Appl. No.: 10/064,752

(22) Filed: Aug. 13, 2002

Related U.S. Application Data

(60) Provisional application No. 60/312,122, filed on Aug. 14, 2001.

(51) Int. Cl.[7] ..... A47L 7/02

(52) U.S. Cl. ..... 15/320; 15/324; 15/344; 15/353; 15/377; 15/384

(58) Field of Search ..... 15/320, 344, 353, 15/384, 377, 383, 324

(56) References Cited

U.S. PATENT DOCUMENTS

| | | | | |
|---|---|---|---|---|
| 1,892,792 A | | 1/1933 | Thompson | |
| 2,740,977 A | | 4/1956 | Allen | |
| 3,184,780 A | | 5/1965 | Hageman | |
| 4,167,798 A | | 9/1979 | Klügl et al. | 15/320 |
| 4,319,852 A | | 3/1982 | Bell et al. | 15/344 |
| 4,776,058 A | | 10/1988 | Garner et al. | 15/320 |
| 4,788,738 A | | 12/1988 | Monson et al. | 15/320 |
| 4,791,700 A | * | 12/1988 | Bigley et al. | 15/324 |
| 4,798,613 A | | 1/1989 | Hetherington et al. | 15/320 |
| 4,899,418 A | | 2/1990 | Steiner et al. | 15/344 |
| 5,099,545 A | | 3/1992 | Krasznai et al. | 15/344 |
| 5,249,333 A | | 10/1993 | Worwag | 15/387 |
| 5,341,541 A | | 8/1994 | Sham | 15/320 |
| 5,367,740 A | | 11/1994 | McCray | 15/320 |
| 5,507,068 A | | 4/1996 | Fan et al. | 15/320 |
| 5,542,147 A | | 8/1996 | Merten | 15/321 |
| 5,590,439 A | | 1/1997 | Alazet | 15/320 |
| 5,599,401 A | | 2/1997 | Brosky et al. | 134/21 |
| 5,664,285 A | | 9/1997 | Melito et al. | 15/352 |
| 5,933,913 A | | 8/1999 | Wright et al. | 15/320 |
| 6,125,498 A | | 10/2000 | Roberts et al. | 15/320 |
| 6,658,693 B1 | * | 12/2003 | Reed, Jr. | 15/344 |

* cited by examiner

*Primary Examiner*—Theresa T. Snider
(74) *Attorney, Agent, or Firm*—McGarry Bair PC

(57) ABSTRACT

A liquid extraction cleaner comprises a solution dispensing system, a liquid recovery system, and an agitation brush assembly. The solution dispensing system includes a cleaning solution supply tank affixed to the cleaner and fluidly connected to a solution spray nozzle through a trigger-operated manual solution spray pump. The supply conduit interconnecting the cleaning fluid supply tank and the spray nozzle traverses a passage formed integrally with the air-liquid separator housing, spray nozzle being mounted in the passage at a front portion of the cleaner. The liquid recovery system includes a air-liquid separator fluidly connected with a suction nozzle and a suction source for drawing liquid and debris into the air-liquid separator, and a recovery tank releasably mounted to the air-liquid separator for collecting recovered liquid. The agitation brush assembly is mounted in a lower forward portion of the cleaner for contact with a surface being cleaned.

19 Claims, 25 Drawing Sheets

HAND-HELD DEEP CLEANER

CROSS REFERENCE TO RELATED APPLICATIONS

This application claims the benefit of U.S. provisional patent application Ser. No. 60/312,122, filed Aug. 14, 2001, entitled HAND HELD DEEP CLEANER.

BACKGROUND OF INVENTION

1. Field of the Invention

This invention relates generally to extraction cleaners and more particularly to a portable, hand-held deep cleaner that applies cleaning fluid to a surface, agitates the surface, and then extracts the applied fluid therefrom.

2. Description of the Related Art

Portable, hand-held extraction cleaners having a cleaning solution supply tank and a recovery tank are known. These extraction cleaners typically have a vacuum motor that powers an impeller to create low pressure on one side of the impeller and higher pressure on the other side thereof. The recovery tank is typically positioned between the low-pressure side of the impeller and a fluid collection nozzle to remove fluid from a surface and deposit it in the recovery tank. It is also known to provide a separate cleaning fluid pump for directing cleaning fluid from the supply tank to the surface.

One hand-held deep cleaning device is disclosed in U.S. Pat. No. 4,788,738 issued to Monson et al. on Dec. 6, 1988. In this arrangement, a hand-held deep cleaner has a handle section removably joined to a lower discharge section. A collection chamber receives fluid from a surface through a nozzle opening that communicates with the intake side of a vacuum motor. The collection tank houses a hollow plenum chamber and a centrifugal separator attached to a vacuum blower. A cleaning fluid tank is pressurized by exhaust air from the outlet side of the rotating vacuum blower to force cleaning fluid under pressure from the cleaning fluid tank to a supply nozzle when a solution supply trigger is depressed to thereby apply cleaning fluid to a surface.

U.S. Pat. No. 5,367,740 issued to McCray on Nov. 29, 1994, discloses a hand-held deep cleaner that includes a housing, a handle, a body portion, and a nozzle with a suction opening. A collection tank is removably supported on the housing and is fluidly connected to a vacuum pump. The vacuum pump has an exhaust port and is powered by an electric pump motor. A solution tank is removably connected to the housing and is pressurized by a pressure pump that is also connected to the pump motor. A separate drive motor is coupled to a rotatable brush for scrubbing a surface to be cleaned.

U.S. Pat. No. 6,125,498 to Roberts et al. discloses a hand-held liquid extraction cleaner including a recovery tank mounted to the forward end of a cleaner housing with a suction nozzle and conduit on a front face of the recovery tank connected to an inlet opening in the recovery tank. A vacuum source is connected to the recovery tank through an exhaust conduit, integrally formed in the recovery tank, for drawing liquid and debris through the suction nozzle and the suction conduit and into the recovery tank. A removable cleaning fluid supply tank is mounted to a rear portion of the cleaner housing, an adjustable spray nozzle is mounted to the suction conduit and a pump is positioned in a supply conduit between the spray nozzle and the cleaning fluid supply tank for supplying pressurized cleaning fluid from the cleaning fluid supply tank to the spray nozzle. The pump includes an impeller which is positioned in an outlet opening of a reservoir in which the cleaning fluid is deposited from the cleaning fluid supply tank.

U.S. Pat. No. 4,776,058 to Garner et al. discloses a portable vacuum surface cleaning apparatus that includes an integrated suction nozzle and recovery tank removably mounted to a forward portion of a housing and a rotatably driven brush mounted to a rear portion of the housing. A cleaning solution tank at a rear portion of the housing has a discharge flow passage directed rearwardly adjacent the brush. An electrical vacuum source is mounted in the housing.

U.S. Pat. No. 5,507,068 to Fan et al. discloses a handheld fluid extractor having a suction nozzle at a front portion thereof, a fluid delivery tank mounted beneath the suction nozzle and a fluid recovery tank mounted beneath the solution tank. A chamber 68 is connected to the suction conduit 82 and separates the air from the recovered liquid which drops from the plenum chamber 68 into the recovery tank 28. The fluid delivery tank and the fluid recovery tank are removable from the suction nozzle.

A commercially available form of the portable vacuum surface cleaning apparatus disclosed in the Garner et al. '058 patent was manufactured and sold by Ryobi Motor Products under the trademark 1344 SPOT COP. The Ryobi SPOT COP extractor did not have a rotary-driven brush agitator and included a fluid dispenser adjacent to the suction nozzle at a front portion of the recovery tank. The cleaning solution was delivered to the spray nozzle from a cleaning solution tank at a rear portion of the housing through a pump.

Heretofore, a hand-held extractor has been manufactured and sold by Royal the mark DIRT DEVIL SPOT SCRUBBER. The Royal SPOT SCRUBBER is similar to the hand-held extraction cleaning machine disclosed in the Roberts et al. '498 patent except that it has a hand pump adjacent to the handle to pump cleaning solution to a spray nozzle adjacent to the suction nozzle. In addition, a rotary brush is mounted to a main housing behind the suction nozzle and is driven about a vertical axis by a turbine motor which is connected to the suction source for the extractor. A valve alternately connects the suction source to the turbine motor and to the suction nozzle.

SUMMARY OF INVENTION

According to the invention, a liquid extraction cleaner includes a housing with a liquid extraction system and a liquid dispensing system. The liquid extraction system includes a recovery tank, suction nozzle connected to the recovery tank, and a vacuum source. An air-liquid separator is integral with the housing and in fluid communication with the suction nozzle for separating air from liquid and debris. The vacuum source is in fluid communication with the recovery tank and the suction nozzle so that the vacuum source can draw liquid and debris through the suction nozzle toward the recovery air-liquid separator. The liquid dispensing system includes a cleaning fluid supply tank and a spray nozzle connected to the cleaning fluid supply tank. In one aspect of the invention, at least one agitator is mounted to the air-liquid separator adjacent to the suction nozzle for rotation about an axis and for scrubbing the surface to be cleaned. A motor is carried by the housing and is operably connected to the agitator to drive rotation of the agitator about the axis of rotation.

Preferably, the recovery tank is removably mounted to the air-liquid separator. The air-liquid separator is mounted to a front portion of the housing adjacent to the air-liquid separator suction nozzle. Typically, the recovery tank has visual indicia to indicate a maximum capacity of recovered liquid and debris.

In another aspect of the invention, the suction nozzle is elongated with a longitudinal axis and the agitator preferably rotates about an axis parallel to the longitudinal axis. The motor can be mounted to the air-liquid separator, and the motor can be operated independently of the vacuum source. In a preferred embodiment, the agitator has more than two rows of bristles.

Preferably, the liquid extraction cleaner according to the invention has at least two agitators rotatably mounted to the air-liquid separator next to the suction nozzle, with each agitator being rotatable in a direction opposite the other. In an alternative embodiment, the liquid extraction cleaner according to the invention can have at least one roller rotatably mounted to the housing next to the suction nozzle, with each roller having a plurality of flexible paddles extending radially therefrom.

In another aspect of the invention, the cleaning fluid supply tank is insulated. In one embodiment, a liquid extraction cleaner includes a supply conduit interconnecting the cleaning fluid supply tank and the spray nozzle. Preferably at least a portion of the supply conduit is insulated. In another embodiment, a double wall insulates the cleaning fluid supply tank with air disposed between the walls.

In yet another embodiment of the invention, a lamp assembly is mounted to a front portion of the housing and connected to a source of electrical energy for illuminating the surface to be cleaned. Preferably, the lamp assembly comprises a lamp, a reflector and a lens and the assembly is mounted to a front portion of the air-liquid separator.

In yet another aspect of the invention, a pump is connected to the cleaning fluid supply tank and operated by a trigger. The housing includes a handle at an upper portion thereof, and the trigger is located at an underside of handle.

DETAILED DESCRIPTION

Figure 1:
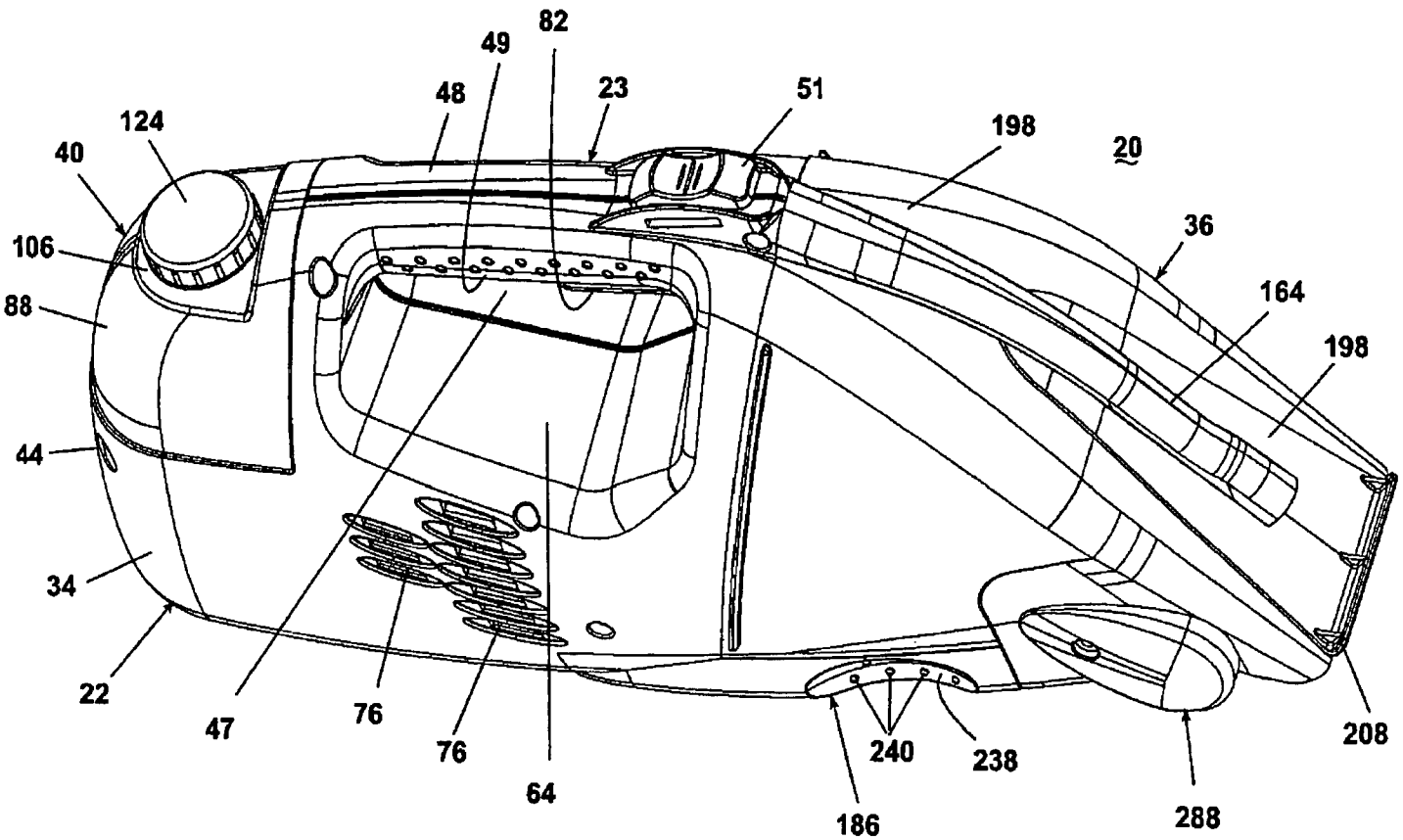
FIG. 1 is a perspective view of a portable, hand-held deep cleaner according to the invention.
Figure 2:
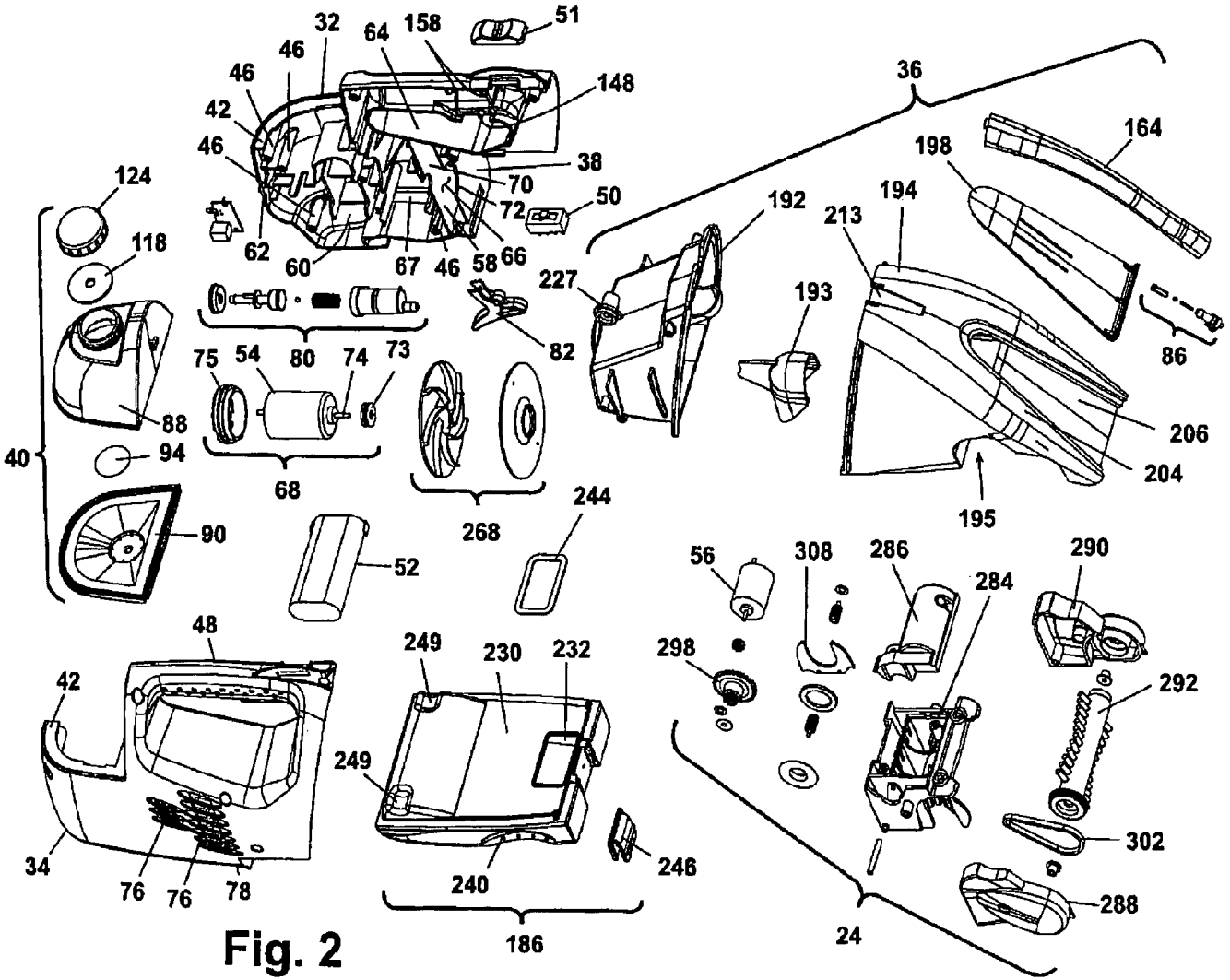
FIG. 2 is an exploded perspective view of the portable, hand-held deep cleaner of FIG. 1.

Referring now to FIGS. 1 and 2, a portable, hand-held deep cleaner 20 comprises a housing 22, a cleaning fluid distribution system, a fluid recovery system, a rotatable agitator brush assembly 24, and a battery pack 52 for supplying electrical power.

The housing 22 is formed by a first shell half 32 and a second shell half 34 that, when mounted together, houses a fluid distribution system and fluid recovery system. An air-liquid separator assembly 36 is mounted on a forward end 38 of the housing 22 and a solution tank assembly 40 is mounted to a rearward portion 44 of the housing 22.

Each shell half 32, 34 includes a plurality of bosses 46 that are in alignment with corresponding bosses 46 in the other shell half. The shelf halves are preferably fastened together by installing threaded fasteners in the bosses in a well known manner to enclose elements of a fluid distribution system, a fluid recovery system, and a battery power source. Each shell half also includes an integrally molded handle portion 48 in the housing 22 that, when assembled together, form a unitary handle 23 having a grip lower surface 49 on the underside of the handle. The lower surface 49 of the handle 23 and an upper wall 64 together partially define a cavity 47 to accommodate a hand opening for hand carrying of the extractor. A switch 50 is connected between the battery pack 52 and an electric vacuum motor 54, and an electric brush motor 56 for alternately starting and stopping the motors 54, 56. In one embodiment, switch 50 is a 3-position switch having a center "off" position and two alternatively selectable "on" positions for activating one or the other of the motors 54, 56. A switch cover 51 covers switch 50.

Figure 15:
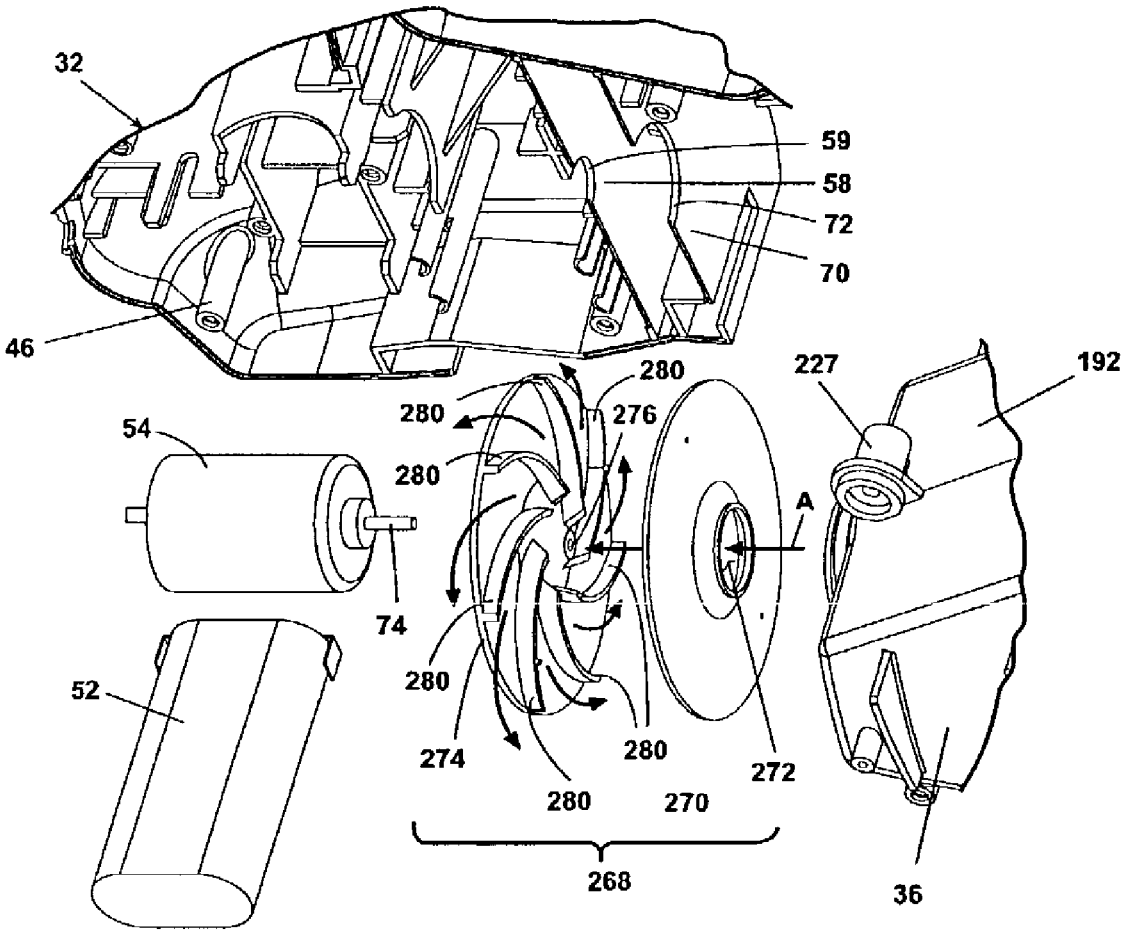
FIG. 15 is an enlarged perspective view of the vacuum motor assembly of the portable, hand-held deep cleaner of FIG. 1.

Each shell half 32, 34 has a pair of spaced, parallel housing ribs 58, 70 that are integrally molded along three sides to a lower wall 60, a sidewall 62, and the upper wall 64 below the handle portion 48. The housing ribs 58, 70 serve as reinforcement members for the shell halves 32, 34 and also define an internal impeller compartment 66 that houses a vacuum impeller assembly 268 (see FIG. 15). Housing rib 70 includes a semi-circular opening 72 for fluidly connecting internal compartment 66 to air-liquid separator assembly 36. Rib 58 also includes a semi-circular opening 59 that receives a bushing 73 receiving the front shaft 74 of the motor 54. Preferably, the openings 59, 72 are collinear with each other.

A second internal compartment 67 is formed to the rear of rib 58 for holding vacuum motor 54. Second internal compartment 67 includes additional rib 63 for positioning vacuum motor 54 in alignment with opening 59.

A plurality of elongate exhaust apertures 76 extend through each shell half 32, 34 and communicate with the internal compartment 66 to permit exhaust air to escape from the internal compartment 66 when the vacuum motor assembly 68 is operating. A plurality of exhaust apertures 76 are also provided in the shell halves 32, 34 adjacent the second internal compartment 67 to vent compartment 67 and to prevent excessive heat build-up in the vacuum motor 54 during operation of the deep cleaner. The exhaust apertures 76 also serve to prevent excessive heat build-up in the housing 22 during recharging of the battery pack 52.

The lower wall 60 of the housing 22 includes a hollow foot portion 78 that maintains the hand-held deep cleaner 20 in substantially horizontal position when not in use. Hollow foot portion 78 includes forwardly disposed open recess 79 adapted to receive a projection from a support base for mounting on a vertical surface.

A fluid distribution system is described comprising a solution tank assembly 40, a solution pump assembly 80, a trigger 82, a plurality of solution supply conduits (not shown), and a spray nozzle assembly 86.

As shown in FIGS. 2–5, the solution tank assembly 40 is mounted to an upper surface 42 of the rearward portion 44 of the housing 22. The solution tank assembly 40 comprises a hollow tank body 88, a lower wall 90 having a first opening 92 extending therethrough and in fluid communication with a fitting 96, a filter screen mounted in the first opening 92, a cap 114 and a seal 118.

The tank body 88 is joined to the lower wall 90 at a peripheral seam 102. A front wall 98 of the tank body 88 extends upwardly from the lower wall 90, preferably at an obtuse angle with respect to the lower wall 90. Front wall 98 further includes a T-shaped flange 100 extending therefrom. Lower wall 90 includes a generally circular depression surrounding first opening 92 and receiving filter screen 94. Filter screen 94 prevents foreign particles in a solution from entering opening 92.

A second opening 104 extends through an upper wall 106 of tank body 88 in the form of a neck portion 108 perpendicular to the upper wall 106. Neck portion 108 includes external threads 112. A generally circular cap 114 is formed with internal threads 116 that correspond with the external threads 112 on the neck portion 108. A seal 118 having a central aperture 119 is positioned between the cap 114 and the top lip 122 of the neck portion 108 to thereby seal the second opening 104.

A vent 124 is formed in a top surface of the cap 114 and serves to prevent a vacuum from forming in solution tank assembly 40 as solution is drawn from the tank by solution pump assembly 80.

The lower wall 90 of the solution tank assembly 40 has a bottom surface 134 including a number of flanges 128 extending toward each outboard edge of and parallel to the bottom surface 134. The flanges 128 are adapted to fit against a mating surface 130 inside both shell halves 32, 34 of housing 22 as the bottom surface 134 is placed against the upper surface 42 formed in the top rearward portion 44 of the housing 22. The T-shaped flange 100 extending from front wall 98 is likewise adapted to fit within housing 22 through a gap 125 in rear wall 126 of housing 22 as front wall 98 abuts rear wall 126.

With solution tank assembly 40 assembled to housing 22, fitting 96 is contained within housing 22, fluidly connecting the interior of solution tank assembly 40 with the housing interior compartment 132. The fitting 96 includes a barbed outer surface 136 that is frictionally retained in an end of a flexible solution tube 81, the other end of which is fluidly connected to the solution pump assembly 80. Solution tank assembly 40 is thereby fluidly connected to the solution pump assembly 80 from whence it can be pumped to the spray nozzle assembly 86 mounted on the forward face 138 of the air-liquid separator assembly 36.

Referring to FIGS. 2, 3, 4, 6 and 7, the solution pump assembly 80 is captured by a pump cavity 140 integrally formed in the interior surface of the upper handle portion 48 of the housing halves 32, 34. The solution pump assembly 80 is further aligned within the handle portion 48 of the deep cleaner 20 by a plurality of conforming ribs 158 for holding fluid chamber 142, an alignment flange 156 on fluid chamber 142 and a trigger pivot boss 148. Alternatively, the solution pump assembly 80 is attached to the first shell half 32 with screws (not shown) that extend through the solution pump assembly 80 and thread into bosses (not shown). The bosses are preferably integrally molded with a sidewall (not shown) of the solution pump assembly 80 and project forwardly therefrom.

The solution pump assembly 80 comprises a pump housing 141 including a fluid chamber 142, a piston assembly 144 having a forward portion sealingly received in fluid chamber 142, a compression spring 146, a trigger assembly 82, a pump inlet 150 and a pump outlet 152.

Figure 7:
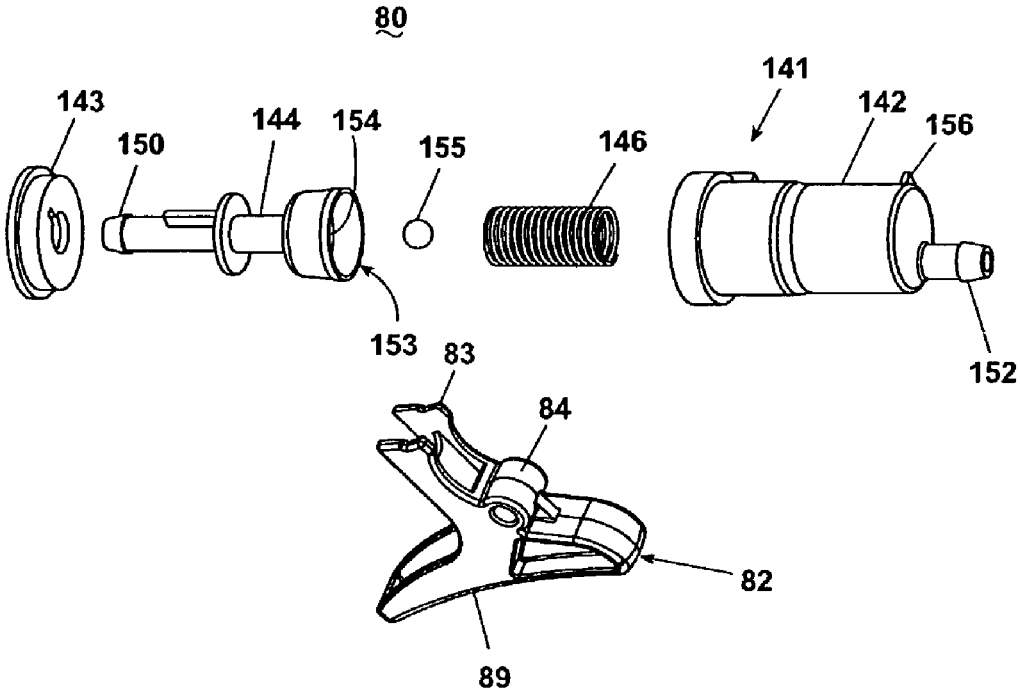
FIG. 7 is an enlarged exploded view of a solution pump assembly of the deep cleaner of FIG. 1.

Pump housing 141 further includes a cap 143 for sealing a rear portion thereof and holding piston assembly 144 within housing 141. Cap 143 includes a central aperture for receiving pump inlet 150. Housing 141 further includes a groove on a lower portion thereof for receiving an actuation arm 83 of trigger 82. Referring to FIG. 7, the trigger 82 comprises a trigger lever 89, which is offset from the actuation arm 83. The trigger lever 89 is adapted to be pulled by a finger while a user's hand grasps the handle 23.

The piston assembly 144 includes a check valve 153 comprising a seat 154 and a ball 155 that prevents the flow of solution from the fluid chamber 142 back through the pump inlet 150. When the trigger lever 89 is pulled, the trigger 82 rotates about a trigger pivot hub 84 on trigger pivot boss 148 and actuation arm 83 moves the piston 144 into the fluid chamber 142, overcoming the force of the compression spring 146 and forcing fluid in the chamber 142 through the pump outlet 152.

As the trigger 82 is released, the compression spring 146 forces the piston 144 back to its original position. As the piston 144 moves back out of the chamber 142, a vacuum is created within chamber 142. A check valve in the spray nozzle assembly 86 prevents air from being drawn into the chamber 142 from pump outlet 152. This vacuum thus causes the ball 155 to dislodge from seat 154 for fluid flow from the solution tank assembly 40 through pump inlet 150 and to fill the fluid chamber 142.

The solution tank assembly 40 is in fluid communication with the solution pump assembly 80 via flexible tube 81 secured at one end to the barb 136 at the tank outlet fitting 96 and at the other end to the pump inlet 150 of the solution pump assembly 80. A second flexible tube 85 fluidly connects the solution pump assembly outlet 152 and the spray nozzle assembly 86 located at the forward face 138 of the air-liquid separator assembly 36. The second flexible tube 85 is encased by transparent conduit 164 attached to the forward face 138 of the air-liquid separator assembly 36.

Figure 8:
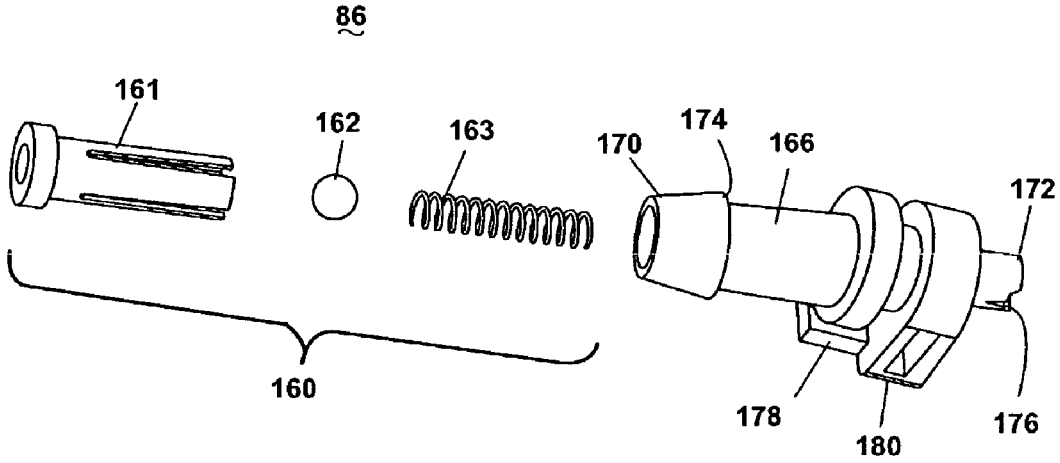
FIG. 8 is an enlarged perspective view of a spray nozzle of the deep cleaner of FIG. 1.
Figure 9:
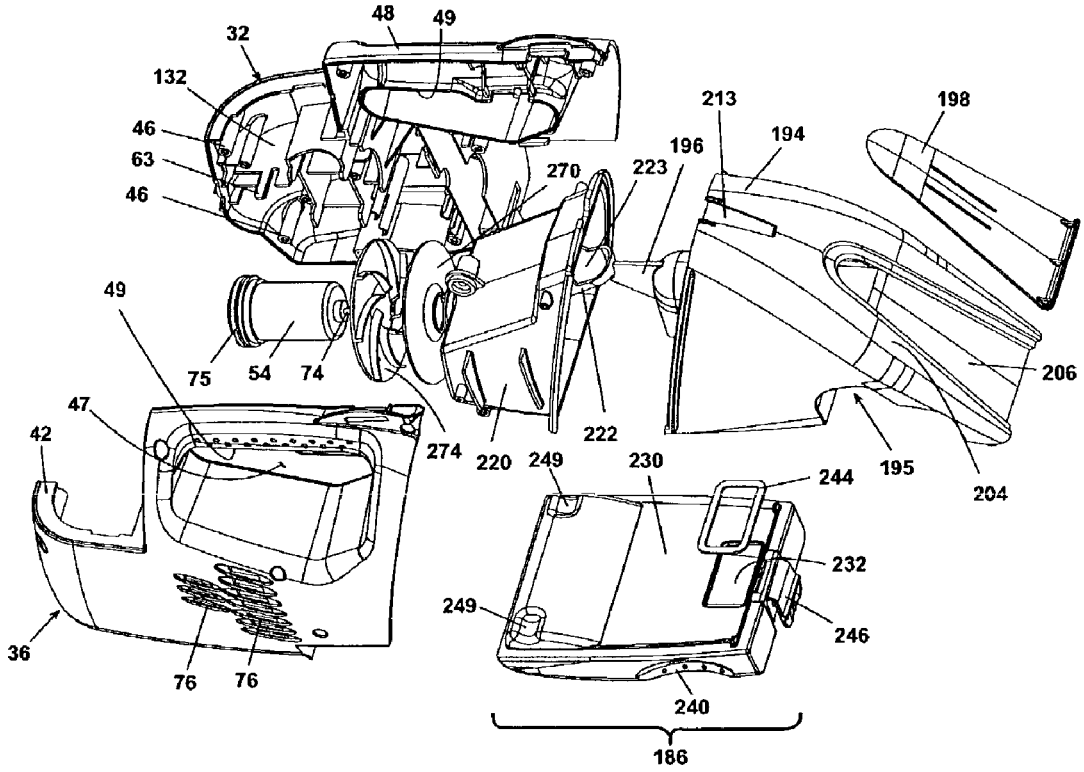
FIG. 9 is an exploded view of the fluid recovery system of the portable, hand-held deep cleaner of FIG. 1.
Figure 10:
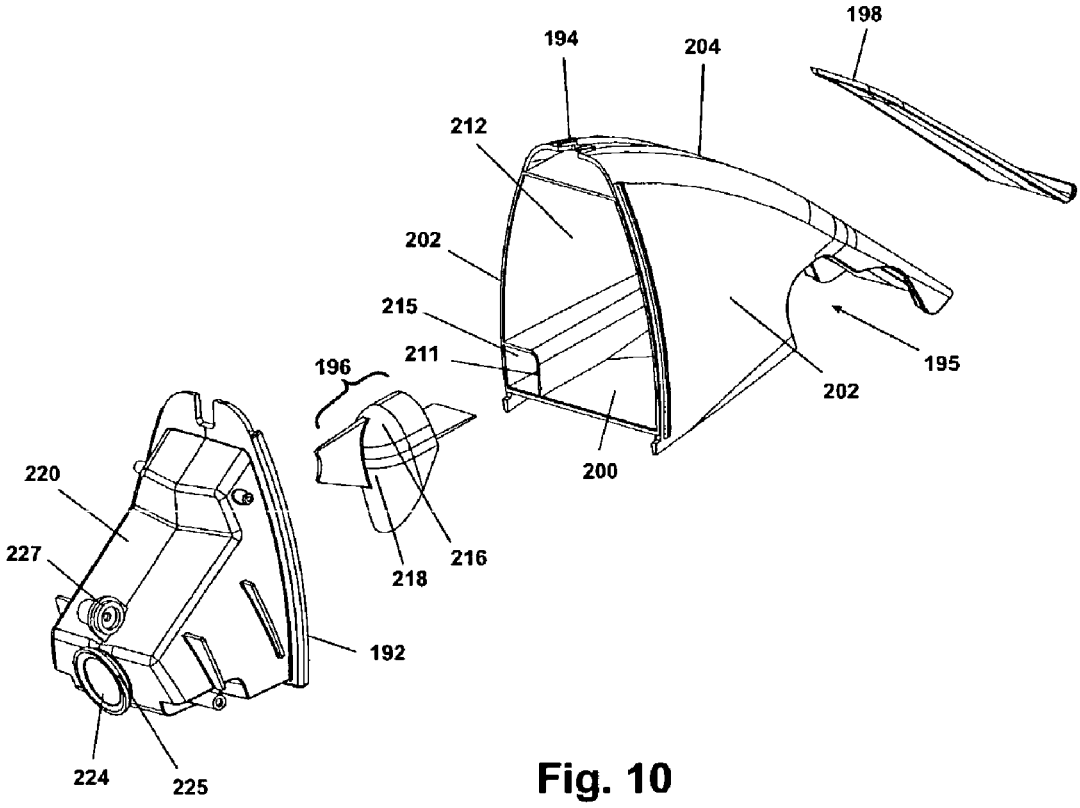
FIG. 10 is an exploded view of the air-liquid separator assembly of the portable, hand held deep cleaner of FIG. 1.

Referring now to FIG. 8, spray nozzle assembly 86 comprises a nozzle body 166 having an inlet 170 and an outlet 172 and a check valve 160 received within inlet 170. Spray nozzle assembly 86 is fluidly connected to solution pump assembly 80 by the flexible tube 85 and is held to forward face 138 of air-liquid separator assembly 36 transparent conduit 164.

The nozzle body 166 is preferably substantially cylindrical in cross section. A bore extends in a longitudinal orientation through the nozzle body 166 from a fluid inlet 170 to a fluid outlet 172, and along the central axis. A barb 174 is formed at the inlet end 170 for connection to the flexible tube 85. A fan-shaped nozzle opening 176 is formed at the outlet end 172 for normally delivering fluid in a fan-shaped pattern under pressure to a surface to be cleaned. The nozzle body also includes a nub 178 and a mounting block 180 projecting from an outer surface of the nozzle body 166. The mounting block is adapted for attachment to the transparent conduit 164 (FIGS. 2, 3 and 6) in order to secure the nozzle body against movement.

Check valve 160 received in inlet 170 of nozzle body 166 includes a valve seat 161 normally sealed by a ball 162 under force of a compression spring 163. As the operator depresses trigger 82, pressure developed in the solution pump assembly 80 overcomes the compression spring 163 to open the check valve 160 and fluid passes through nozzle assembly 86. When trigger 82 is released and the pressure within solution pump assembly 80 decreases, compression spring 163 forces ball 162 back against seat 161 and check valve 160 thereby prevents air from being drawn toward solution pump assembly 80.

With reference also to FIGS. 2, 3, and 9–16, the fluid recovery system includes a air-liquid separator assembly 36, a recovery tank 186, a working air conduit 188, and a vacuum source.

The air-liquid separator assembly 36 includes a rear chamber section 192 attached to a front chamber section 194, a deflector 196, and a channel cover 198. The air-liquid separator assembly 36 includes bosses located on rear chamber section 192 for attachment to housing 22. A brush cavity 195 is located at a forward lower section of front chamber section 194 for mounting of the rotating brush assembly 24.

The front chamber section 194 has a bottom wall 200, a pair of sidewalls 202 and a sloping front face 204. A channel 206 is formed in the front face 204. An inlet opening 217 is formed at an upper portion of channel 206 and fluidly connects channel 206 with an interior chamber 212 of front chamber section 194. A generally square shaped electrical conduit 215 comprising an outer wall 211 spans the interior chamber 212 to enclose electrical wiring running from the switch 50 to the brush motor 56. A locating recess 213 is located at an upper portion of the sloping front face 204 and serves to locate the transparent conduit 164. The channel cover 198 fits snugly over the channel 206 to enclose channel 206 and form an elongated suction nozzle opening 208 at a lower portion of channel 206. Suction nozzle 208 is thereby fluidly connected with inlet opening 217 of the air-liquid separator assembly 36. The suction nozzle opening 208 is elongated and has a longitudinal axis. A generally rectangular opening 214 is formed in bottom wall 200 of front chamber section 194 for fluidly connecting to the recovery tank assembly 186.

Deflector 196 is attached to front chamber section 194 over inlet opening 217 to deflect airs liquids, and debris downwardly within the interior chamber 212. The deflector 196 is an integrally molded one-piece assembly including an arcuate upper portion 216 adjacent the inlet opening 217 to the interior chamber 212 and a depending portion 218 extending downwardly into the interior chamber 212. Both portions 216, 218 include curved sides to form a generally concave deflector 196 about the inlet opening 217 to channel recovered fluid toward a lower portion of the interior chamber 212.

The rear chamber section 192 comprises an outer shell 220 and an integrally molded conduit 222. A locating boss 227 is formed on a rearward portion of outer shell 220 to provide alignment between air-liquid separator 36 and housing 22 during assembly. Conduit 222 comprises an outer wall 221, a working air inlet 223 positioned inside the interior chamber 212, and, at a second end, a working air outlet 224 intersecting the outer shell 220 at an integrally molded collar 225. The collar 225 is adapted to be received in the semi-circular openings 72 of front housing ribs 70 to fluidly connect interior chamber 212 of the air-liquid separator assembly 36 with internal compartment 66 of the housing 22.

The air-liquid separator assembly 36 is seated against a forward end 38 formed of the housing 22 with collar 225 retained in semi-circular openings 72 of front housing ribs 70. The rectangular opening 214 in the bottom wall 200 of front chamber section 194 is in fluid communication with the recovery tank assembly 186. The air-liquid separator assembly 36 is essentially integral with the housing 22 in the sense that it is inseparable from it. Preferably, the air-liquid separator assembly 36 is adhesively bonded to the forward end 38 of the housing 22.

Referring now to FIGS. 2, 3, 9 and 11–13, recovery tank assembly 186 comprises a lower tank portion 228, an upper tank portion 230, a seal 244 and a latch 246. Lower tank portion 228 and upper tank portion 230 form together a substantially enclosed tank having a single rectangular opening 232 with latch 246 attached at a forward portion thereof.

The upper tank portion 230 has a preferably rectangular opening 232 located at the forward end 234 for fluid communication with a corresponding preferably rectangular opening 214 in the front chamber section 194 of air-liquid separator assembly 36. Seal 244 surrounds rectangular opening 214 to form a watertight seal between upper tank portion 230 and air-liquid separator assembly 36. A pair of arcuate recesses 249 are located on a rearward portion of upper tank 230 to provide a bearing surface with the shell halves 32, 34.

Lower tank portion 228 includes two sidewalls 236 each including a depression 238 with nubs 240 extending therefrom to facilitate handling the recovery tank assembly 186 during removal and installation thereof with respect to the portable hand-held deep cleaner 20. Lower tank portion 228 further includes a slot 250 at a forward portion thereof for receiving latch 246. A flange 260 projects outwardly from a rearward wall 258 of lower tank portion 228.

Figure 11:
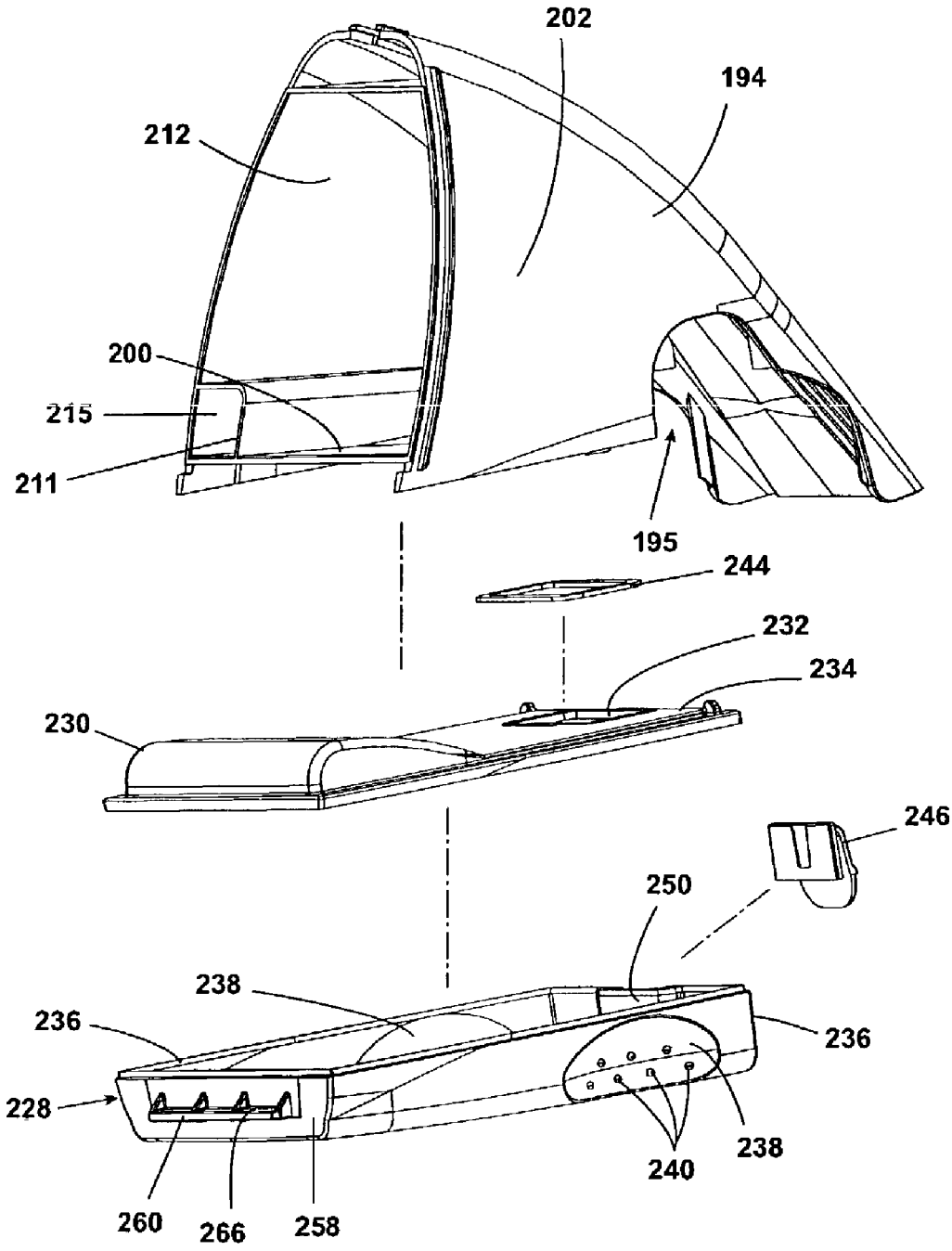
FIG. 11 is another exploded view of a portion of the air-liquid separator assembly and recovery tank of the portable, hand-held deep cleaner of FIG. 1.
Figure 12:
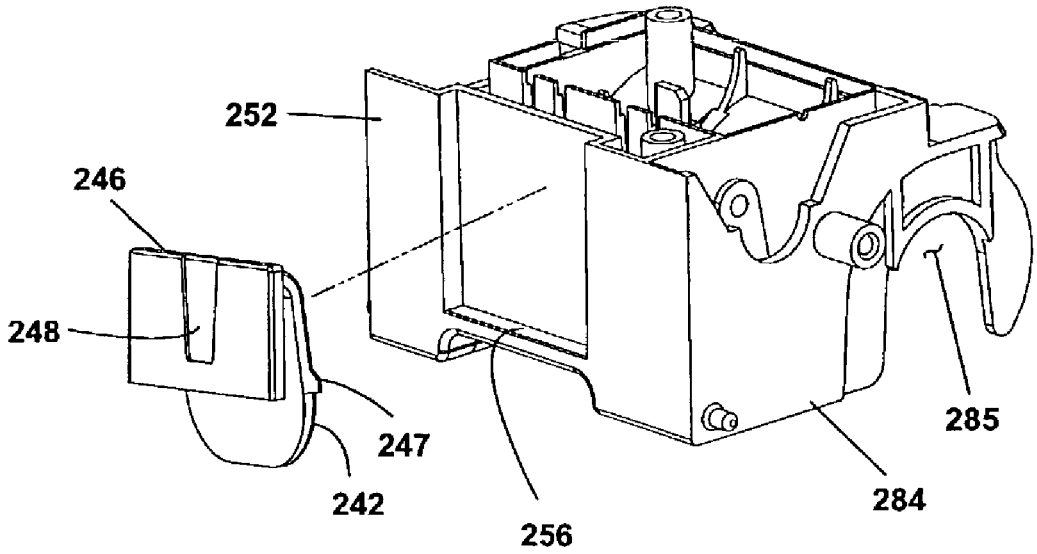
FIG. 12 is an exploded perspective view of the air-liquid separator assembly latch and lower brush housing of the portable, hand-held deep cleaner of FIG. 1.
Figure 13:
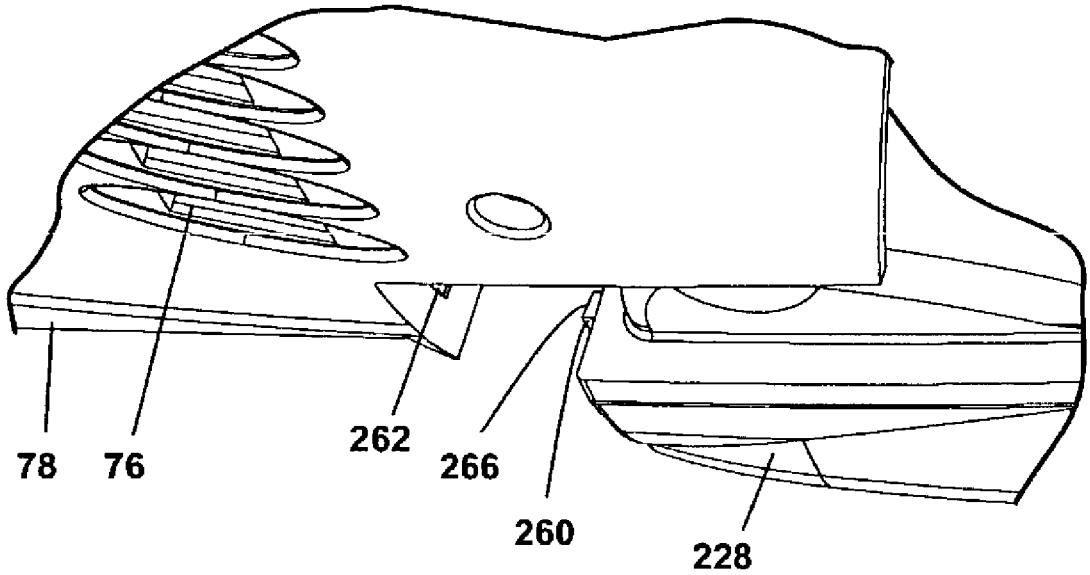
FIG. 13 is a partial view of the air-liquid separator assembly rear flange and the housing of the portable, hand-held deep cleaner of FIG. 1.
Figure 14:
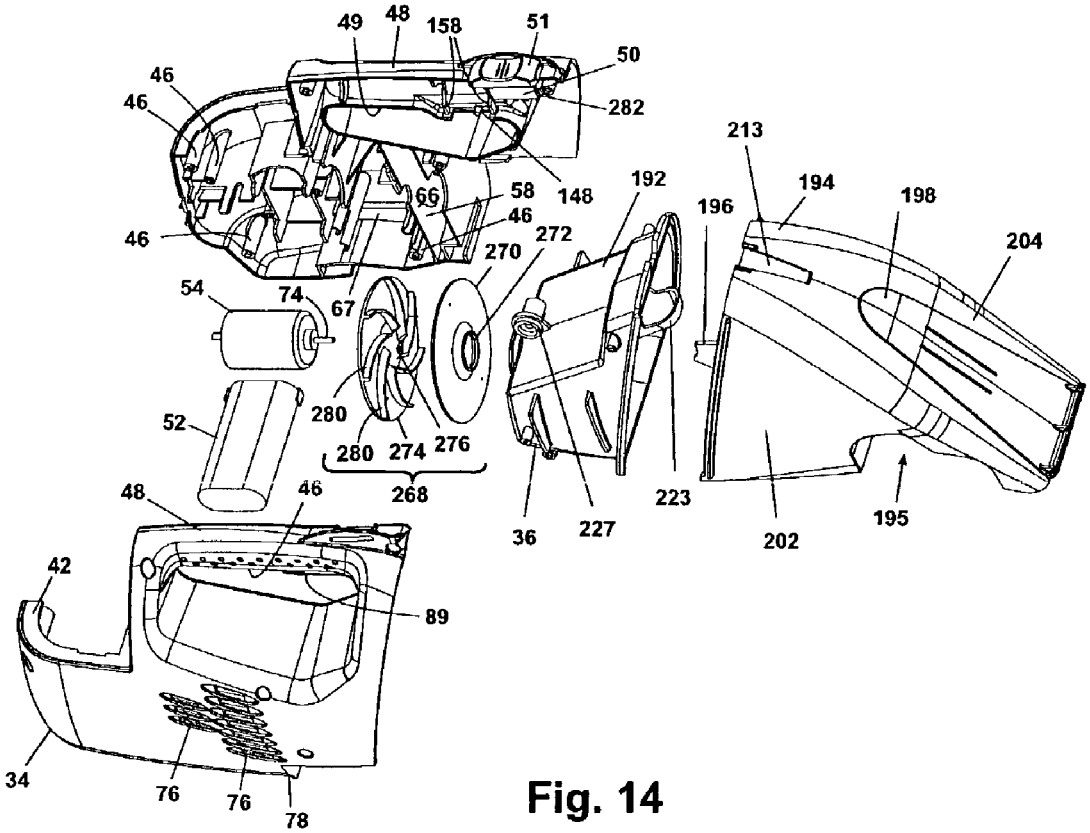
FIG. 14 is an exploded view of the vacuum source, the air-liquid separator assembly, and the housing of the portable, hand-held deep cleaner of FIG. 1.

As shown in FIGS. 11–13, latch 246 includes a base portion 248 for receipt in slot 250 integrally formed with a resilient arm 242 having a projection 247. Projection 247 cooperates with a lip 256 on a rearward face 252 of a lower brush housing 284 to retain recovery tank assembly 186 against the lower face of air-liquid separator assembly 36.

Recovery tank assembly 186 is pivotally mounted to housing 22 by inserting flange 260 into a groove 262 formed in forward end 38 of housing 22. Recovery tank assembly 186 is rotated upwardly so that projection 247 bears against lip 256 and resilient arm 242 is depressed until projection 247 overcomes lip 256. Tank assembly 186 is thus releasably retained against the air-liquid separator assembly 36 by projection 247 beneath lip 256.

Recovery tank assembly 186 is removed from housing 22 by pressing against resilient arm 242 until projection 247 clears lip 256 and then rotating tank assembly 186 downwardly about flange 260 until tank assembly 186 is clear of housing 22. As shown in FIGS. 11 and 13, the rear flange 260 includes a flat defining an interior edge 266. The flange 260 seats in the groove 262 with the edge 266 blocking dislocation from the groove 262 and providing a pivot point for rotation of the recovery tank assembly 186 relative the groove 262 of housing 22. It will be apparent that the recovery tank assembly 186 is removable without also removing the air-liquid separator assembly 36, which remains fixed to the housing 22.

Referring again to FIGS. 2, 3, 9, 14 and 15 the front impeller assembly 268 includes a front curved plate 270 having an air inlet 272, a rear plate 274 spaced from the front plate 270 with an opening 276 for receiving the front shaft 74 of the motor 54, and a plurality of arcuate vanes 280 positioned between the front and rear plates 270, 274. Preferably, each vane 280 curves radially outwardly from the air inlet 272 to draw air into the inlet 272 from the air-liquid separator assembly 36, as represented by direction arrows A in FIG. 3, and expels the air from between the plates. The air expelled from the impeller assembly 268 is exhausted from the housing 22 through the exhaust apertures 76. The air inlet 272 in the front plate 270 is in fluid communication with the working air outlet 224 of the air-liquid separator assembly 36. Working air outlet 224 is sealingly attached to front housing rib 70 by integrally molded collar 225. Impeller compartment 66 is thus fluidly connected with the air-liquid separator assembly 36 at front housing rib 70, and is substantially fluidly isolated from vacuum motor compartment 67 by bushing 73. The vacuum motor shaft 74 passes through bushing 73 into impeller compartment 66. Impeller assembly 268 is mounted on shaft 74 for rotational movement within impeller compartment 66.

A vacuum motor 54 is located within the housing 22 within the internal compartment 67 defined behind the rib 58 defining a rear wall of impeller compartment 66 on the interior of the housing 22. A front portion of the motor 54 is substantially supported by shaft 74 and bushing 73, with a rear portion of the motor supported by a motor mounting base 75 held by internal ribs of the housing formed for that purpose. The aforementioned front impeller assembly 268 is connected to the shaft 74 of the vacuum motor 54 for rotational movement within the impeller compartment 66. The vacuum motor 54 is electrically connected to a power source such as a battery 52 through a switch 50 located in the upper handle portion 48 of the housing 22.

Figure 3:
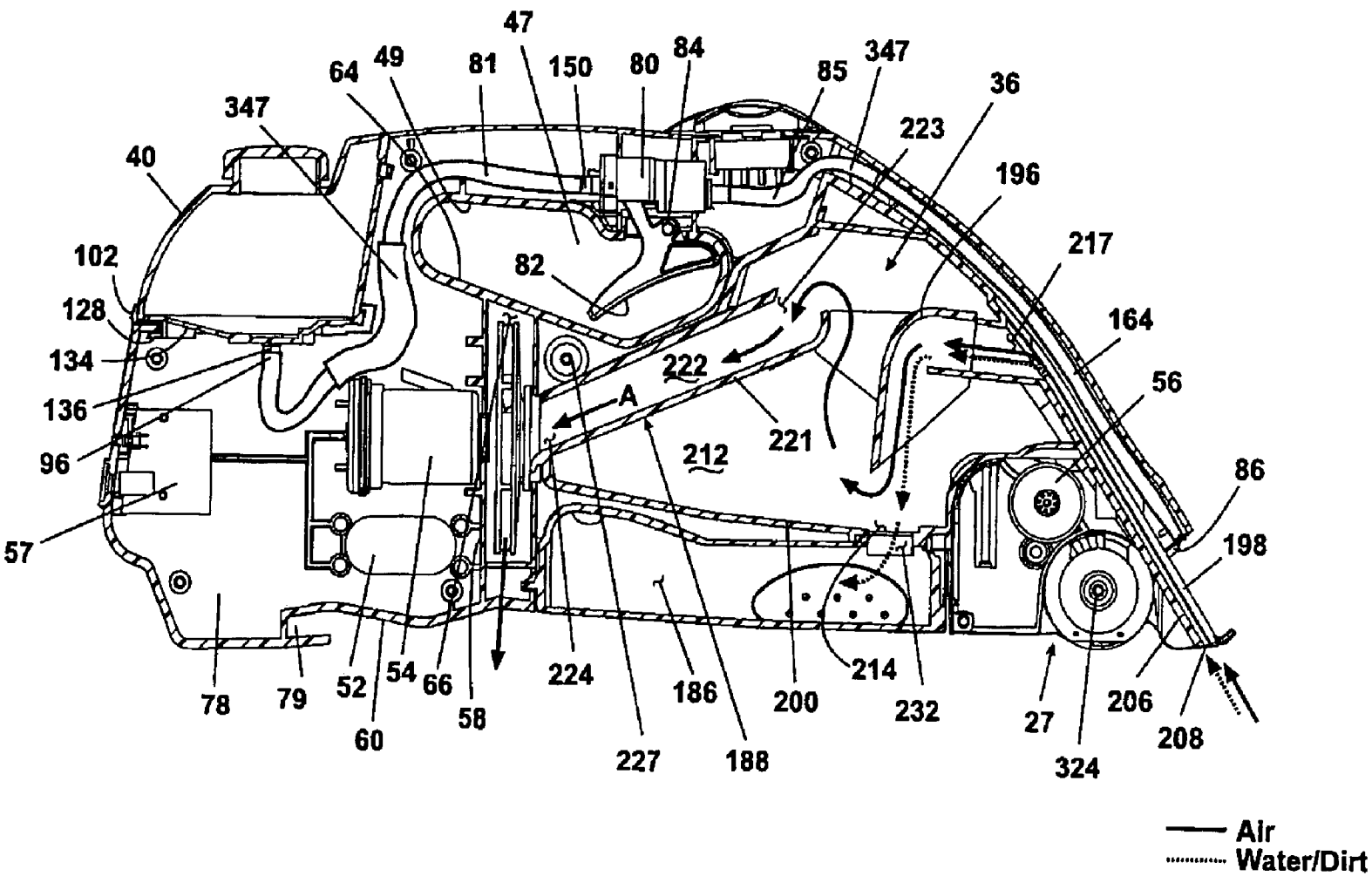
FIG. 3 is a cross section of the portable, hand-held deep cleaner of FIG. 1.
Figure 4:
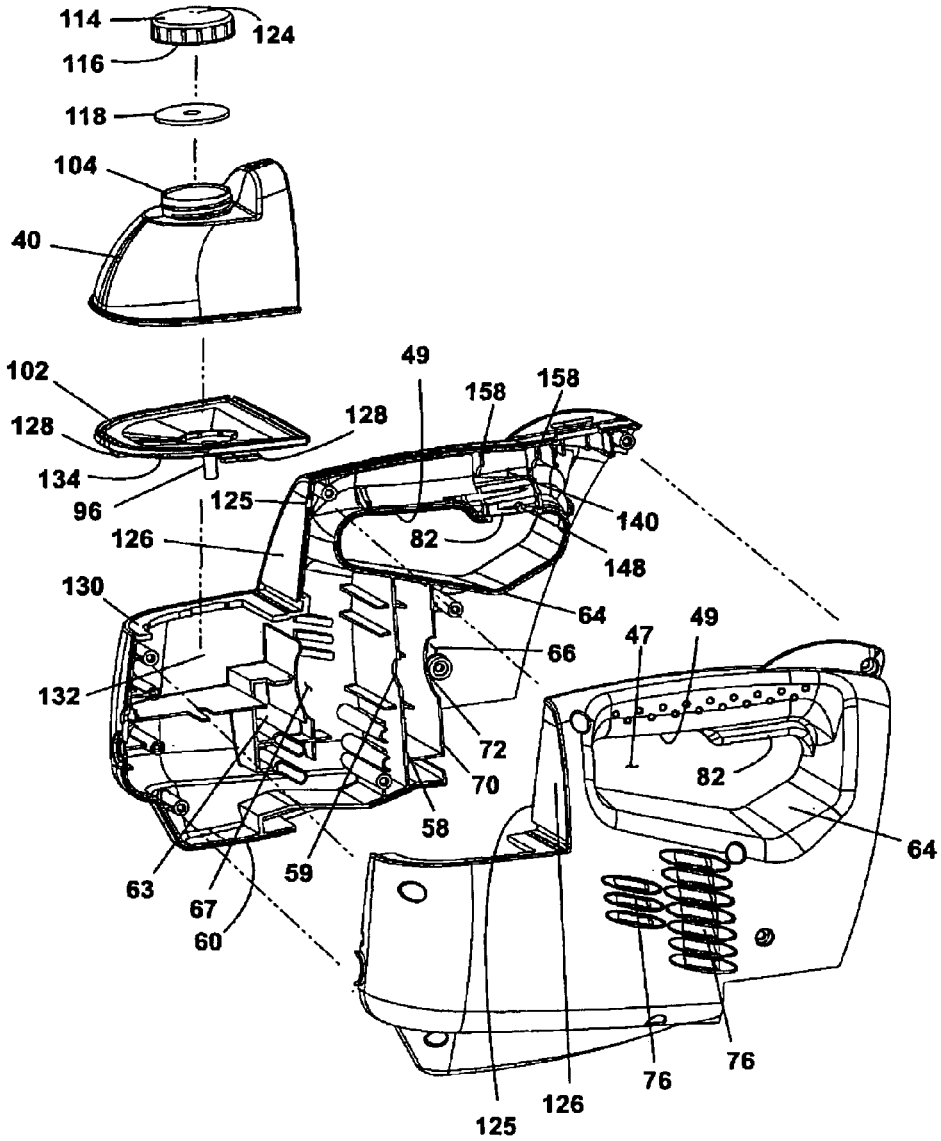
FIG. 4 is an exploded view of the solution supply tank and housing of the portable, hand-held deep cleaner of FIG. 1.

Referring to FIG. 3, a working air conduit comprises a fluid pathway from the suction nozzle opening 208 through the exhaust apertures 76. The working air conduit begins at the suction nozzle opening 208, extends through the front face channel 206, into the interior chamber 212 of the air-liquid separator assembly 36, and through the conduit 222 to the impeller compartment 66 and the exhaust apertures 76.

Water and other debris is separated from the flow of air as the combined flow is first diverted downwardly by deflector 196 and is then diverted again to enter the working air inlet 223. The dirt and water contained in the working air flow will be separated from the air and will settle to the bottom of the interior chamber 212 of the air-liquid separator assembly 36 and will drain through the rectangular opening 232 into the recovery tank 186. Working air continues through an upper portion of the air-liquid separator assembly 36, into the working air inlet 223, through the conduit 222, through the working air outlet 224, into the impeller assembly 268, and out a plurality of exhaust apertures 76 in the side of the housing halves 32, 34. Airflow is indicated by arrows in FIG. 3.

Referring to FIGS. 2, 3, 12 and 16, an agitator in the form of a rotating brush assembly 24 is mounted to the air-liquid separator assembly 36 and positioned adjacent to the rear of suction nozzle opening 208. The brush assembly 24 comprises upper and lower brush housings 286, 284, first and second end caps 288, 290, the electric brush motor 56, a brush roll 292 and associated connecting members as will be furthered described. Lower brush housing 284 further comprises a cavity 285 in which brush roll 292 is free to rotate. The brush roll 292 rotates about an axis parallel to the longitudinal axis of the suction nozzle opening 208.

Lower brush housing 284 and upper brush housing 286 form an internal compartment 310 therebetween. The compartment 310 includes a plurality of ribs 308 adapted to mount electric brush motor 56. Electric brush motor 56 has a shaft 295 mounting a first gear 296. A sidewall 309 of compartment 310 includes an opening 297 for receiving shaft 295 and separating compartment 310 from a second internal compartment 312. With shaft 295 received in opening 297, first gear 296 is in second internal compartment 312.

A second gear 298 rotatably mounted on a shaft 300 is also mounted within second internal compartment 312, and includes a first set of gear teeth 299 intermeshed with first gear 296. A second set of teeth 301 project through an opening 314 to the outside of lower housing 284. Electric brush motor 56 and second gear 298 are held within upper and lower brush housings 286, 284 which are mounted together by fasteners such as screws (not shown) in cooperation with a plurality of bosses 306.

Brush roll 292 is positioned between the first and second end caps 288, 290. A plurality of bristles 325 are located in a generally V-shaped configuration on opposing sides of the brush roll 292 in the longitudinal axis.

Brush roll 292 includes a first end 303 including a brush roll gear 304 and a second end 305. Second end 305 is adapted to receive a brush shaft 324 and brush bushing 322 for receipt in a bearing surface 294 on second end cap 290. First brush end 303 also receives a brush end 324 and brush bushing 322 for receipt in first end cap 288, and is further adapted to be operably connected to second gear 298 by a brush drive belt 302 engaging second set of teeth 301 and brush roll gear 304. First and second end caps 288, 290 are removably mounted to respective sides of upper and lower belt housings 286, 284 through use of a threaded fastener received in bosses 317 on the side of lower housing 284.

Referring again to FIG. 16, first and second end caps 288, 290 are attached to opposite ends of the brush motor lower brush housing 284. Each end cap includes a recess 316 that is in alignment with bosses 317 on the lower brush housing 284. In the preferred embodiment, the end caps 288, 290 are constructed of a transparent material to allow for visual inspection of the brush roll 292 contained therein.

The end caps 288, 290 are preferably fastened to the lower brush housing 284 by installing threaded fasteners in the bosses in a well known manner to secure the end caps to the lower brush housing 284. An interior surface of the end caps 288, 290 creates the bearing surface 294. The bearing surface 294 communicates with the brush bushing 322, which is in communication with the brush shaft 324.

The brush shaft 324 is in communication with a cavity on the end of the brush roll 292 coaxially oriented with the brush roll gear 304. The brush drive belt 302 can be accessed for replacement or any other required maintenance by removing first end cap 288 from lower brush housing 284, performing the required maintenance, and replacing first end cap 288.

Referring to FIGS. 2, 3, 14 and 15, battery pack 52 is located within a cavity defined by the plurality of ribs 58 on the interior of the housing 22. The battery pack 52 is electrically connected to a recharging circuit 57 comprising a printed circuit board and associated commonly known electrical components for supplying a recharging current to the battery pack 52. The battery 52 is further selectively electrically connected to the electric vacuum motor 54 and the electric brush motor 56 through a switch 50 located in the upper handle portion 48 of the housing 22.

In operation, fluid is delivered to the surface to be cleaned when the solution pump assembly trigger 82 is engaged. Fluid is drawn from the solution tank assembly 40 and through the solution pump assembly 80. The solution pump assembly 80 forces fluid through a tube 85 and exits the spray nozzle 86 in a fan-shaped pattern.

In an alternate embodiment (see FIGS. 19 and 20), fluid is delivered when the trigger is depressed, simultaneously energizing an electric solution pump and opening a valve in the supply conduit to deliver pressurized solution to the spray nozzle.

The suction nozzle opening 208, the suction channel 206, the interior chamber 212 of the air-liquid separator assembly 36, and the conduit 222 are in fluid communication with each other and the vacuum source 68 created by the front impeller 268 to draw air and entrained liquid and debris from the surface being cleaned and deposit the liquid and debris in the interior of the recovery tank when the vacuum motor 54 is operating.

In the preferred embodiment, the recovery tank is designed to have a capacity of about 20 ounces, whereas the solution tank has a capacity of about 8 ounces. It is contemplated that with normal use of the hand-held deep cleaner, the liquid collected in the recovery tank will be eight ounces or less before emptying. Further, if the deep cleaning machine is held vertically for cleaning vertical surfaces for example, the liquid will collect principally in the recovery tank assembly 186 and ordinarily will not enter the air inlet 272 in the air conduit. The recovery tank assembly 186 is disengaged from the portable hand-held deep cleaner 20 by depressing the latch 246 on the forward end 234 of the recovery tank assembly 186. The recovery tank assembly 186 is then free to rotate on the back flange 260 until the flange clears the groove 262 in the housing 22 and allows the recovery tank assembly 186 to be removed. It will be apparent that the recovery tank assembly 186 is removable without also removing the air-liquid separator assembly 36, which remains fixed to the housing 22.

Figure 5:
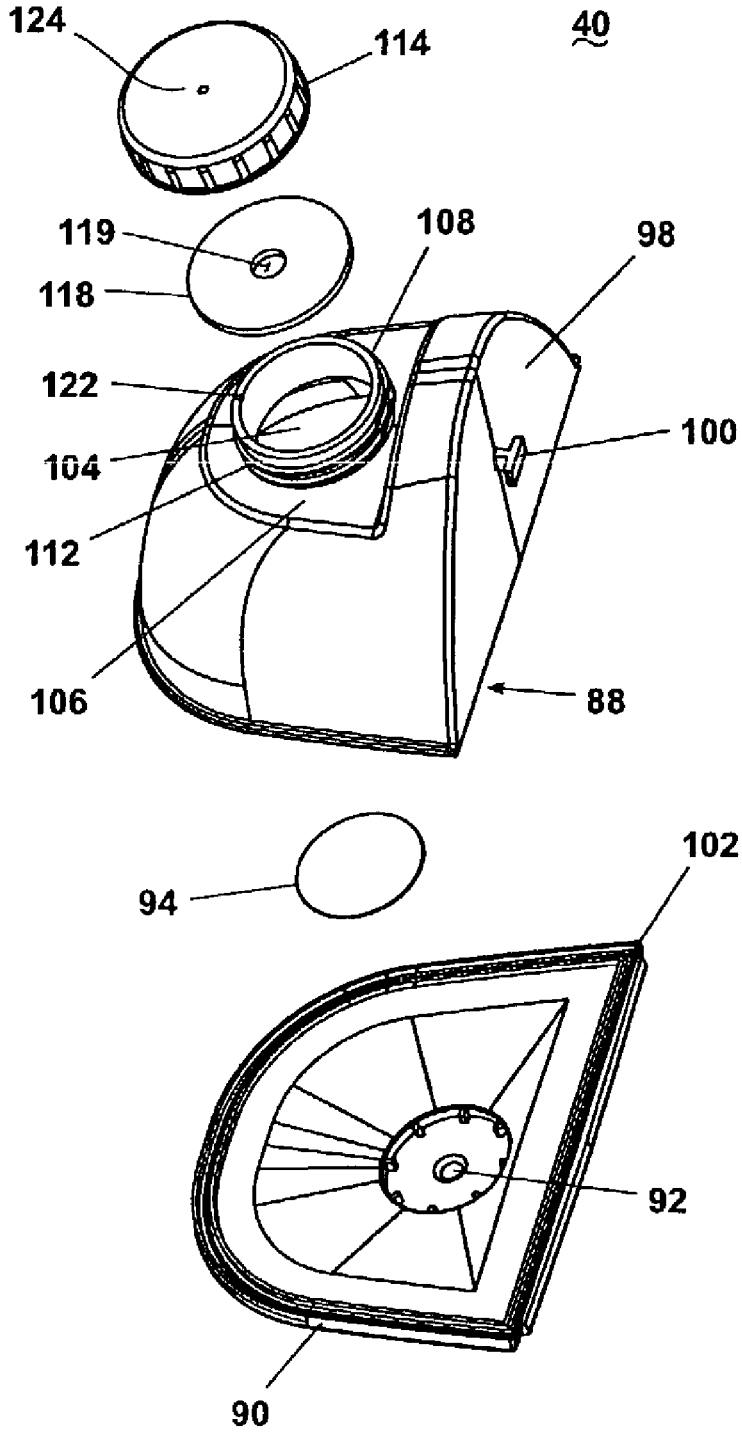
FIG. 5 is an exploded top perspective view of the solution supply tank of the portable, hand-held deep cleaner of FIG. 1.
Figure 6:
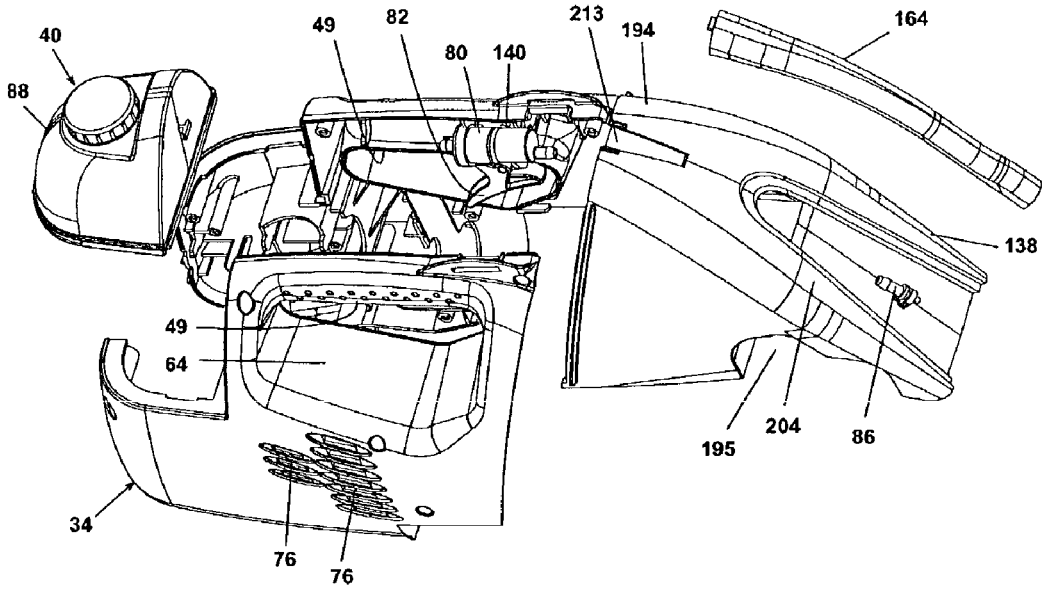
FIG. 6 is an exploded perspective view of a portion of the fluid distribution system of the portable, hand-held deep cleaner of FIG. 1.
Figure 17:
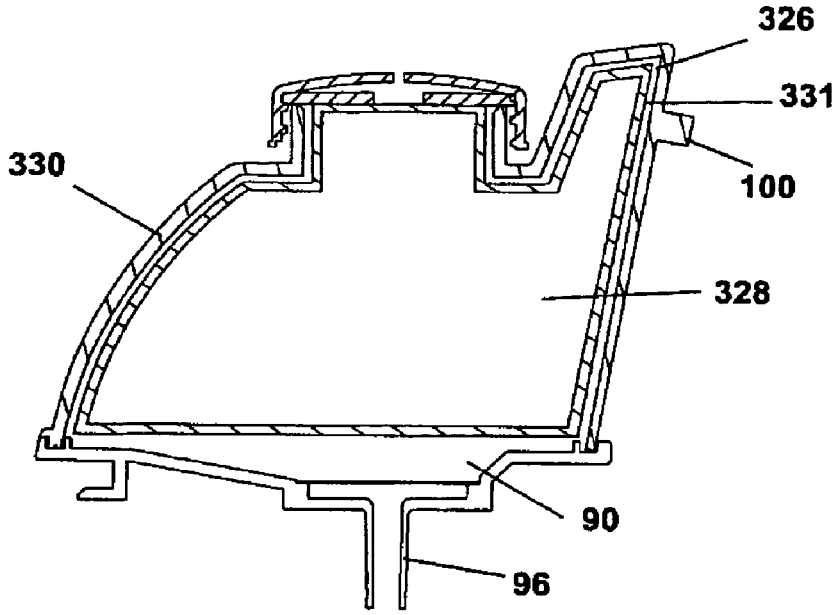
FIG. 17 is a cross-sectional view of a solution tank assembly according to a further embodiment of the invention.

Referring to FIG. 17, a further embodiment of the solution tank 40 shown in FIG. 5 comprises an exterior wall 330 and an interior wall 331 forming a double wall construction. The solution tank further comprises an insulator 326 between the interior wall 331 and the exterior wall 330. Interior wall 331 defines an interior chamber 328 of the solution tank. In one embodiment, the solution tank is formed from a single blow-molded material. The insulator 326 may be comprised of air or a solid insulating material.

Figure 18:
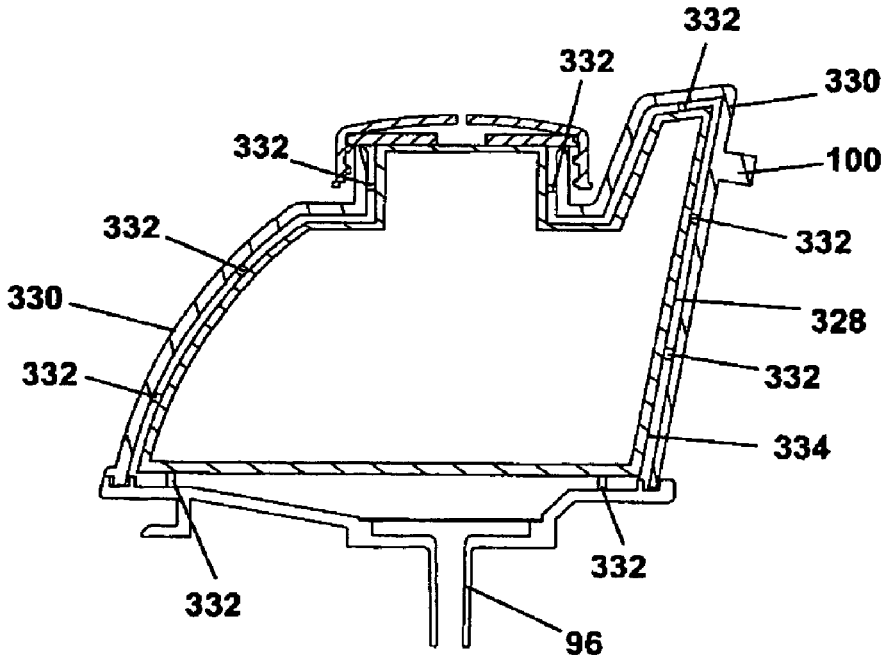
FIG. 18 is a cross-sectional view of a solution tank assembly according to a further embodiment of the invention.

In a further embodiment and referring to FIG. 18, the interior chamber 328 is formed by a single injection-molded element. The interior chamber 328 is spaced from the solution tank exterior wall 330 by a plurality of ribs 332 extending in a perpendicular fashion from the exterior surface of the interior chamber to form an air space 334 between the interior chamber 328 and the exterior wall 330. The resulting air space 334 insulates the warm solution contained in the solution tank and impedes heat transfer from the inner chamber 328 to the exterior wall 330.

Figure 19:
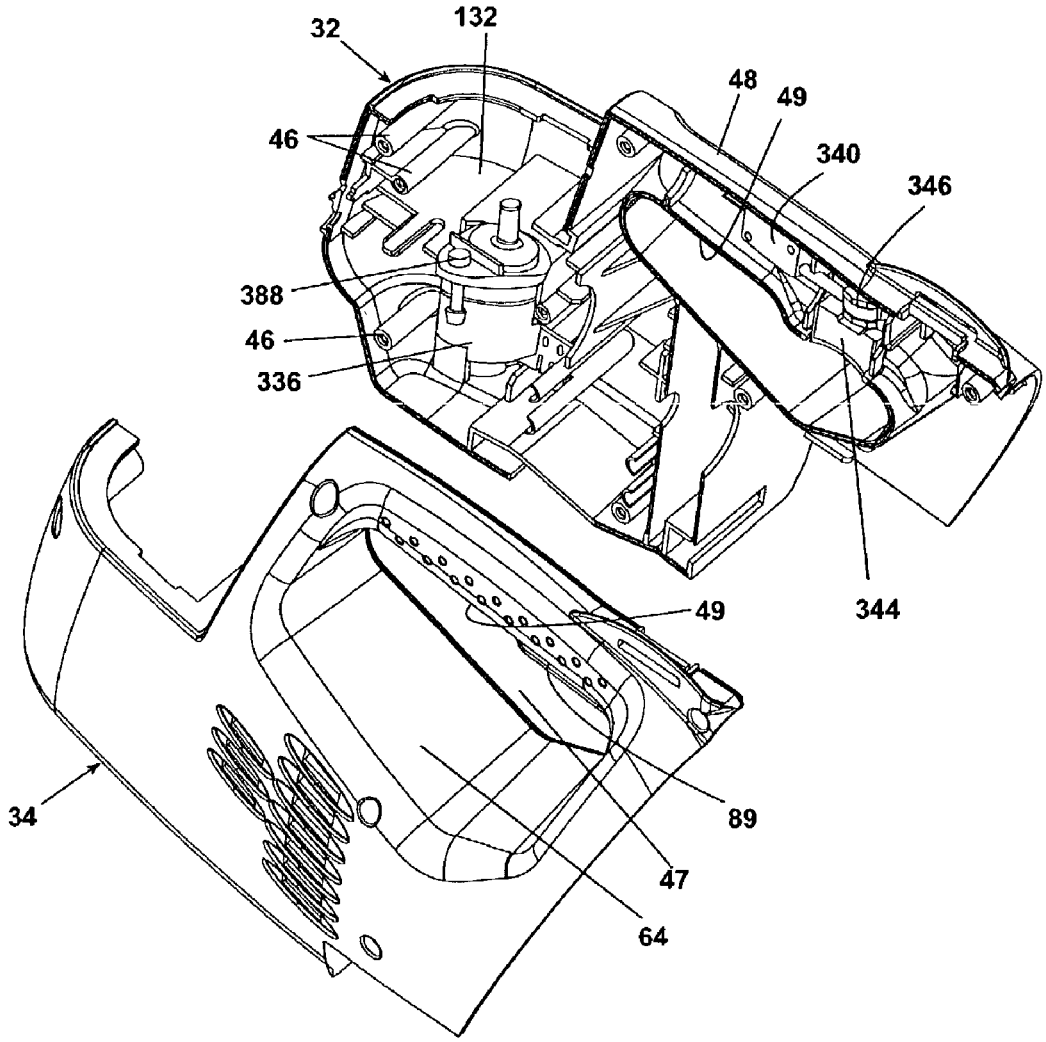
FIG. 19 is an exploded partial perspective view of a hand-held deep cleaner housing according to a further embodiment of the invention.
Figure 20:
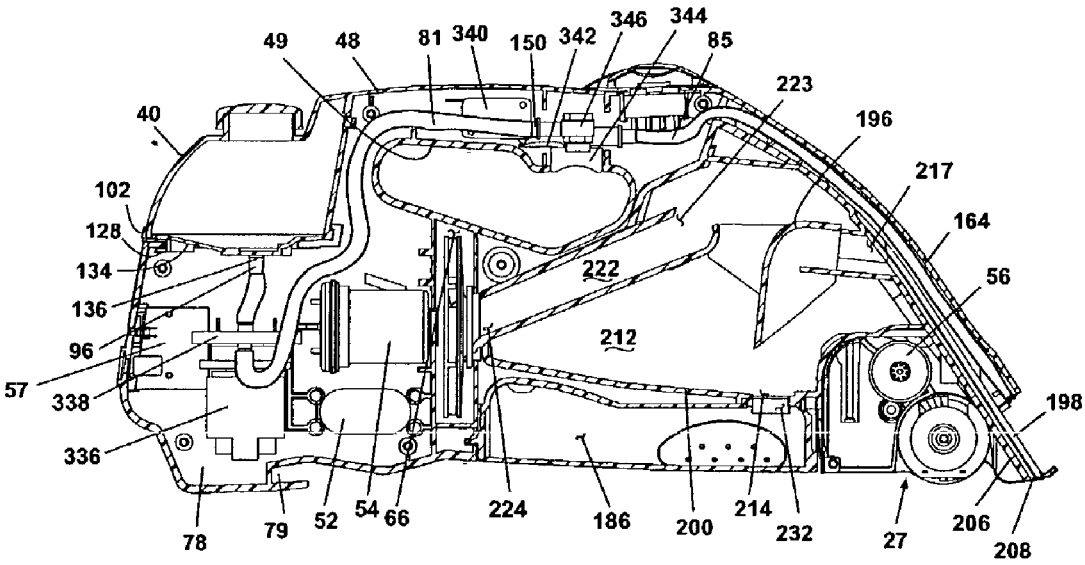
FIG. 20 is a cross-sectional view like FIG. 3 of a further embodiment of the hand-held deep cleaner, according to the invention.

Referring to FIGS. 19–20, in a further embodiment of the pump 80 as shown in FIGS. 2, 3, 6, and 7, an electric pump motor 336 drives a solution pump 338 to provide pressurized solution to the system. The electric pump motor 336 is activated by a microswitch 340 that closes a circuit between the battery pack 52 and the electric pump motor 336. The microswitch 340 is located in a cavity formed in the upper handle housing 48. A tang 342 on the trigger 344 is oriented to operate the microswitch 340 when depressed. The trigger 344 simultaneously operates a solution valve 346 to fluidly connect the solution pump 338 to the nozzle 86. When the trigger 344 is depressed, the solution valve 346 opens and the electric pump motor 336 is simultaneously energized which operates the solution pump 338 and provides a flow of pressurized solution from the solution tank 40 to the nozzle 86.

In a further embodiment of the supply tubes 81, 85 as shown in FIG. 3, are covered with an insulating jacket 347 to impede the loss of heat from a hot solution.

Figure 21:
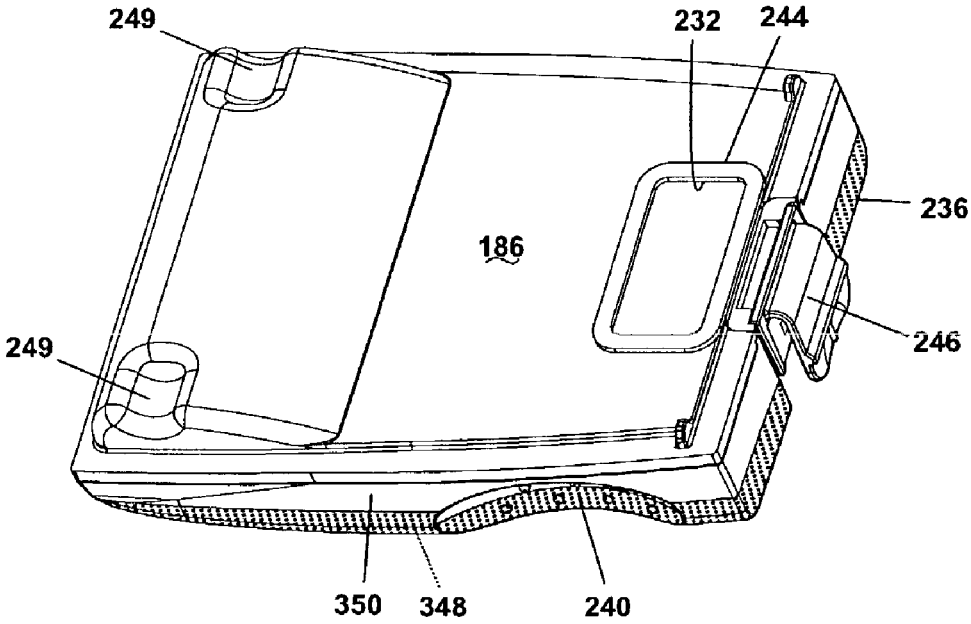
FIG. 21 is a perspective view of a recovery tank according to another embodiment of the invention.
Figure 22:
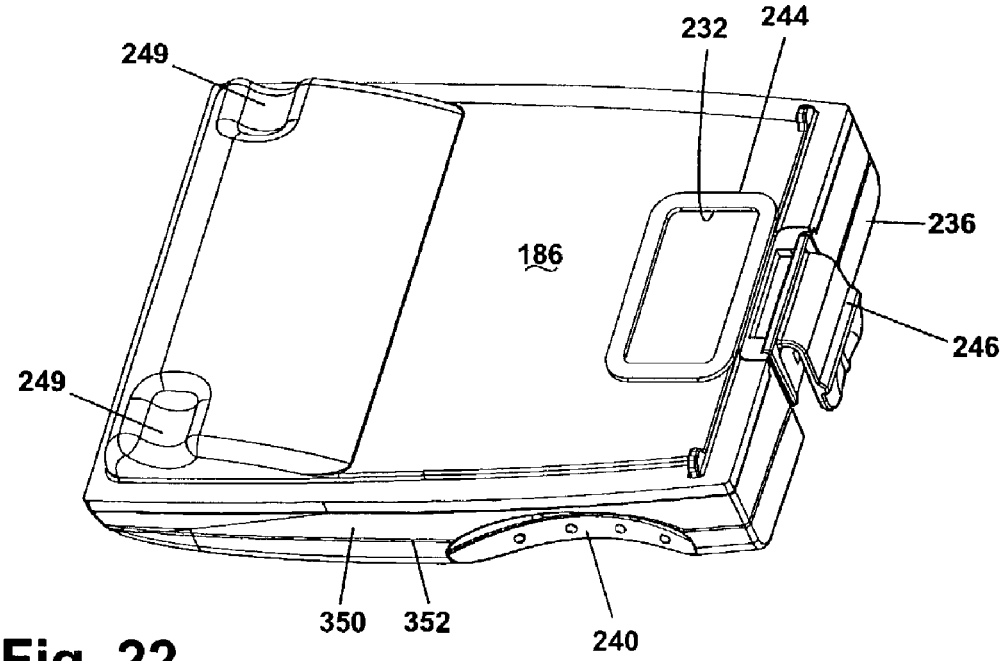
FIG. 22 is a perspective view of a recovery tank according to a further embodiment of the invention.

Referring to FIGS. 21–22 in a further embodiment of the recovery tank 186 as shown in FIGS. 1–3, capacity indicia are formed into the sidewall 236. In one embodiment shown in FIG. 21, the lower portion of the sidewall 236 is textured to form an opaque finish 348. The sidewall top portion 350 is transparent, thus enabling a user to visually inspect the recovery tank contents.

Referring to FIG. 22 in a further embodiment of the recovery tank 186 as shown in FIGS. 1–3, the capacity indicia comprise a horizontal line 352 molded into the sidewall 236. In this embodiment, the entire surface of the sidewall 236 is transparent.

The recovery tank 186 is constructed of thermoplastic materials that are resistant to the high heat and humidity encountered in a commonly known dishwashing appliance.

Figure 16:
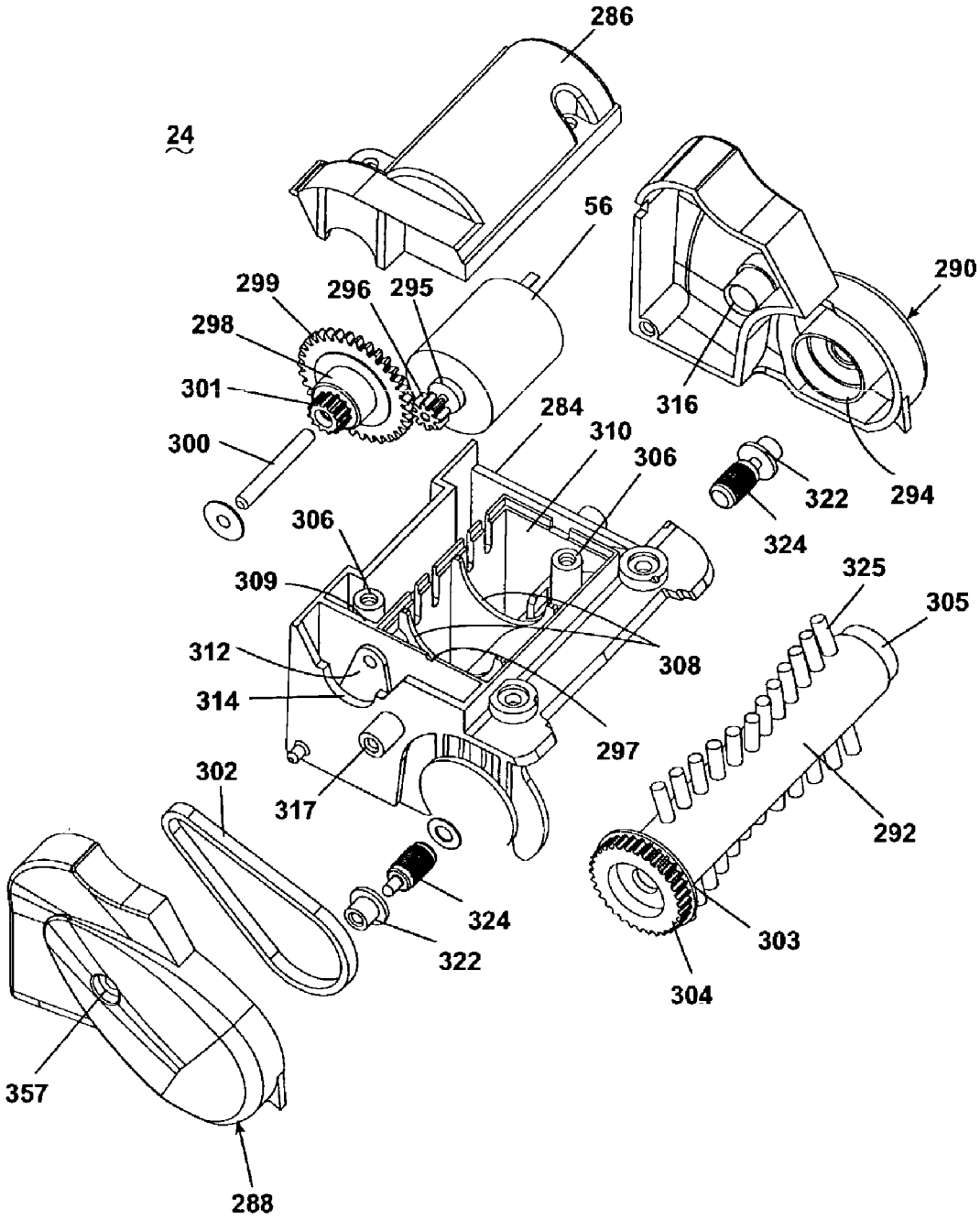
FIG. 16 is an exploded view of the rotating brush assembly of the portable, hand-held deep cleaner of FIG. 1.
Figure 23:
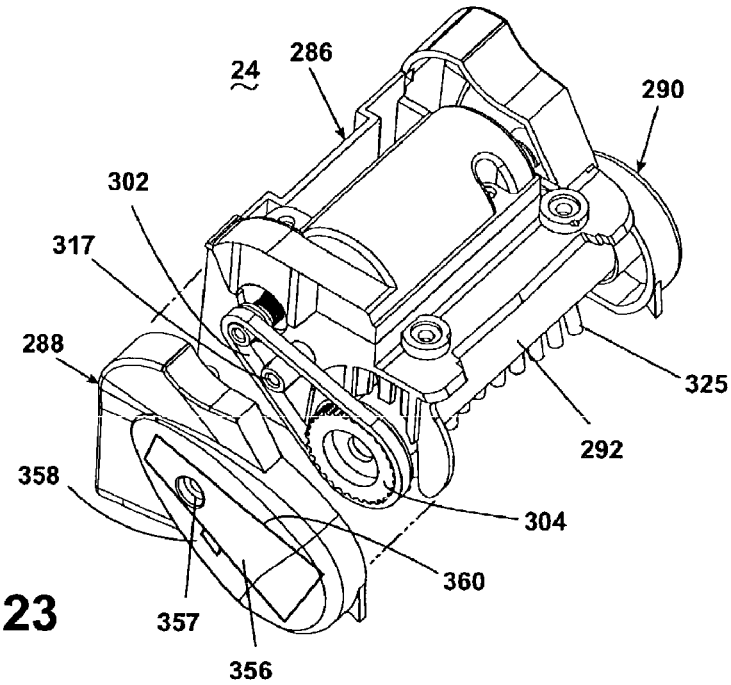
FIG. 23 is a perspective view of a brush assembly according to a further embodiment of the invention.
Figure 24:
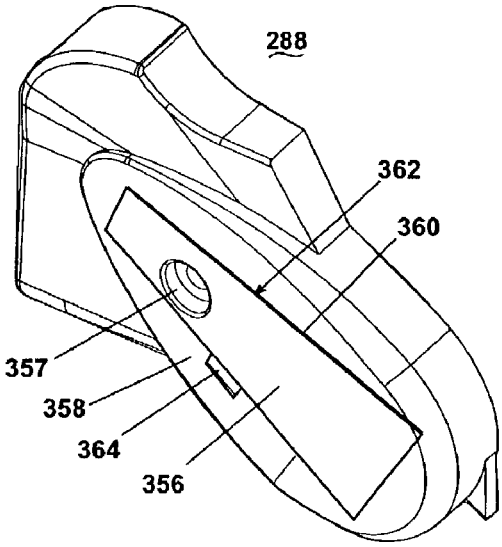
FIG. 24 is a perspective view of an end cap for the brush assembly of FIG. 23.
Figure 25:
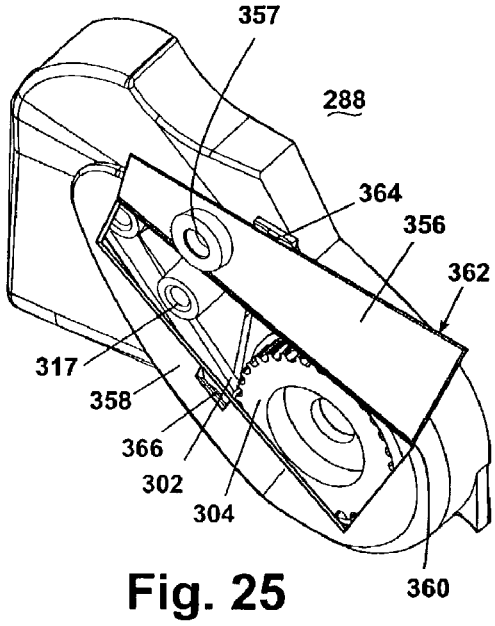
FIG. 25 is a perspective view of the end cap of FIGS. 23–24 with an open brush belt access door.

Referring to FIGS. 23–25 in a further embodiment of the brush end caps 288, 290 as shown in FIG. 16, an access panel 356 is located in the face 358 of the first end cap 288. The access panel 356 comprises a living hinge 360 on an upper surface 362 and a tab 364 on the lower surface. The tab 364 engages a recess 366 in the first end cap 288. A screw head recess 357 is formed in the access panel. Screw boss 317 is in alignment with recess 357. Access panel 356 is secured in place with a screw (not shown) through the recess 357 and into the boss 317. When the screw is removed and the tab 364 is released from the recess 366, the access panel 356 rotates about the living hinge 360 providing clear access to the brush belt 302.

In a further embodiment, the access panel and the first end cap 288 comprise complementary tongue and groove elements arranged so that the access panel is removed by lateral movement parallel to the face 358 of end cap 288 to provide access to the brush belt 302.

Figure 26:
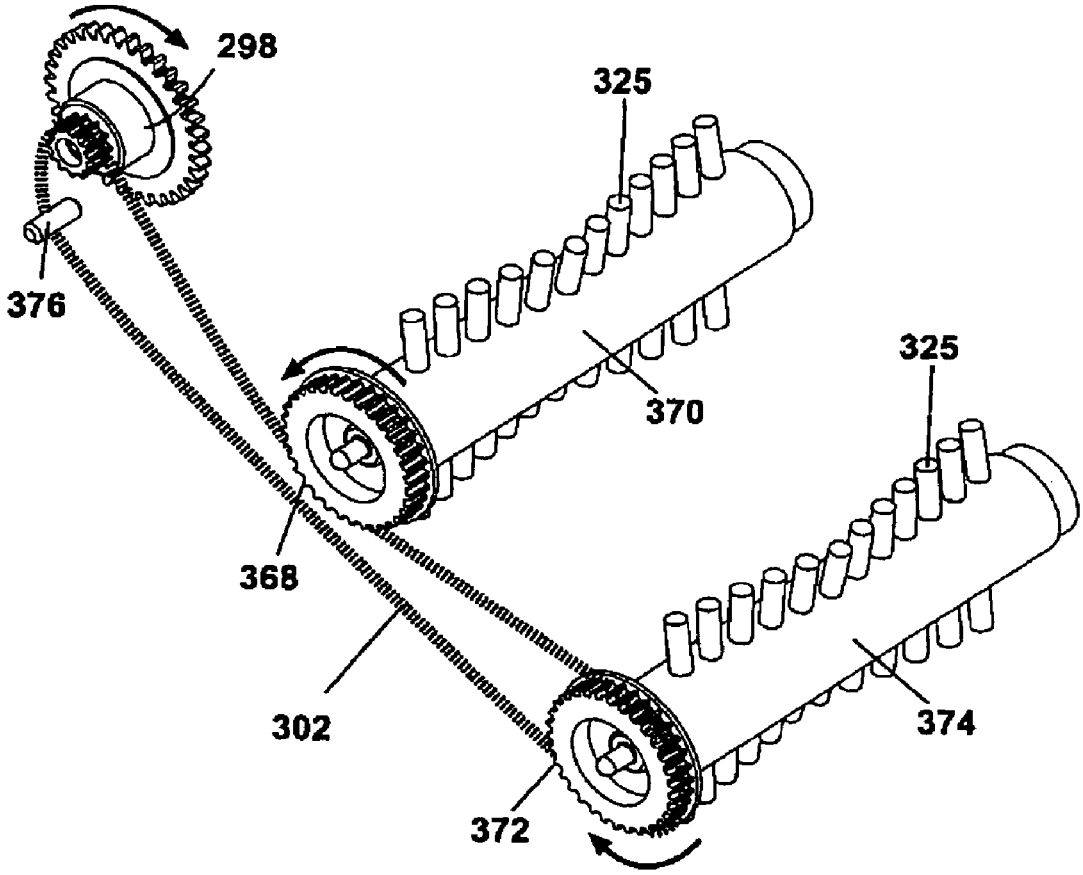
FIG. 26 is a perspective view of a dual agitation brush assembly according to a further embodiment of the invention.

Referring to FIG. 26, a further embodiment of the brush assembly as shown in FIG. 16 comprises two brush rolls 370 and 374 with bristles 325 located parallel to one another. The brush belt 302 passes from the brush motor gear 298, under the first brush roll gear 368 on the first brush roll 370, then under the second brush roll gear 372 of the second brush roll 374, to an idler pulley 376 and then back to the brush motor gear 298. The brush rolls are thus caused to rotate in opposite directions, towards each other, such that debris is agitated and lifted from the surface.

Figure 27:
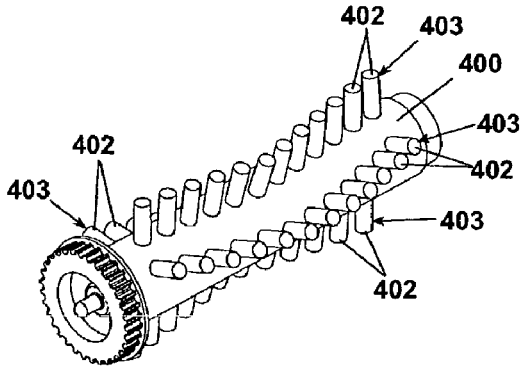
FIG. 27 is a perspective view of a further embodiment of the agitation brush according to the invention.

Referring to FIG. 27 in a further embodiment of brush roll 292 as shown in FIG. 16, a single brush roll 400 consists of a plurality of bristle tufts 402 arranged in more than two rows 403 at an angle to the longitudinal axis of the brush roll 400.

Figure 28:
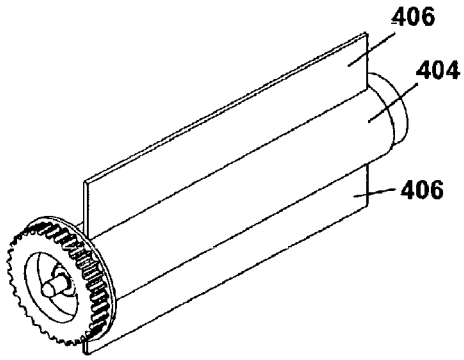
FIG. 28 is a perspective view of a further embodiment of the agitation brush according to the invention.

In a further embodiment of brush roll 292 shown in FIG. 16 and referring to FIG. 28, a brush roll 404 comprises a plurality of flexible paddles or wipers 406 arranged at an angle to the longitudinal axis of the brush roll 404 in a similar orientation to the bristle tufts described in the previous embodiment.

Figure 29:
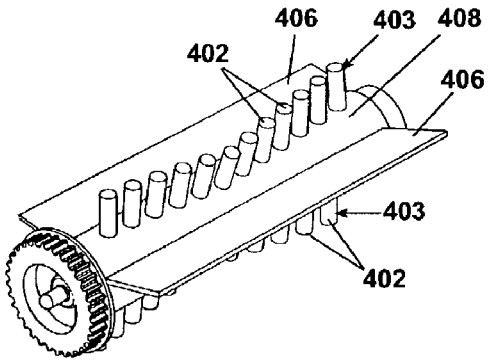
FIG. 29 is a perspective view of a further embodiment of the agitation brush according to the invention.

In a further embodiment of brush roll 292 shown in FIG. 16 and referring to FIG. 29, a brush roll 408 comprises a combination of bristle tufts 402 and flexible paddles or wipers 406 arranged about the brush roll 408.

Figure 30:
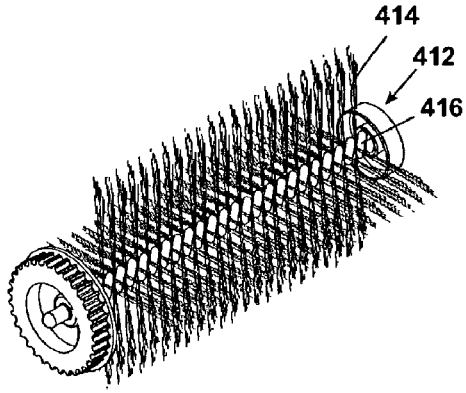
FIG. 30 is a perspective view of a further embodiment of the agitation brush according to the invention.

In a further embodiment of brush roll 292 shown in FIG. 16 and referring to FIG. 30, a brush roll 412 in the form of a twist-wire brush comprises a continuous helix of bristles 414 bound together by a twist-wire spindle 416.

Figure 31:
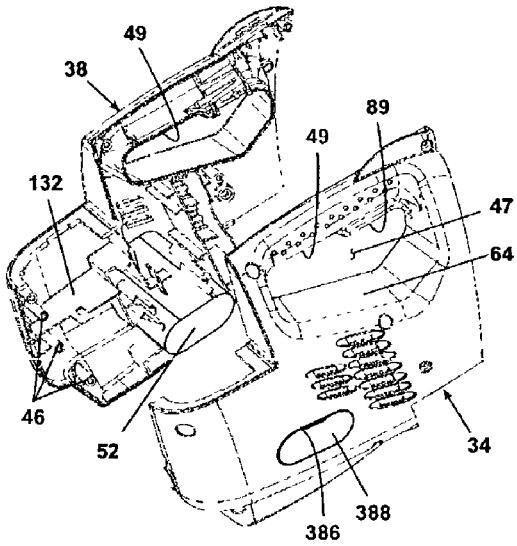
FIG. 31 is an exploded perspective view of a hand-held deep cleaner housing according to a further embodiment of the invention.
Figure 32:
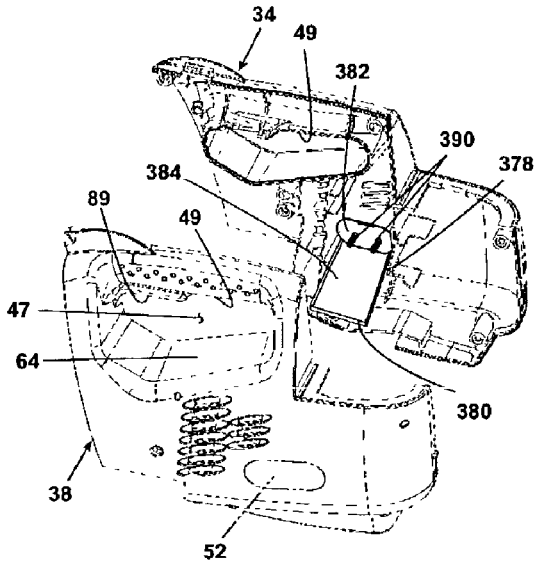
FIG. 32 is a reverse exploded perspective view of the hand-held deep cleaner housing of FIG. 31.

In a further embodiment of the battery pack 52 as shown in FIGS. 2, 3, 14, and 15, and referring to FIGS. 31–32, the battery pack 52 rests in a tray 378. The tray slides on rails 380 formed by ribs 382 on the interior surface of the housing 384. An end panel 386 is integrally formed on the tray 378 and is configured to conform to the exterior surface 388 of the housing 22 over the battery pack area. A screw (not shown) retains the battery tray 378 to the housing through a boss. The interior of the tray contains a cathode and an anode surface that corresponds with the battery pack terminals. A compression spring 390 maintains engagement of the battery terminals with the tray cathode and anode. An external battery charger is provided to charge the battery pack when the battery pack is not in use in the deep cleaner.

Figure 33:
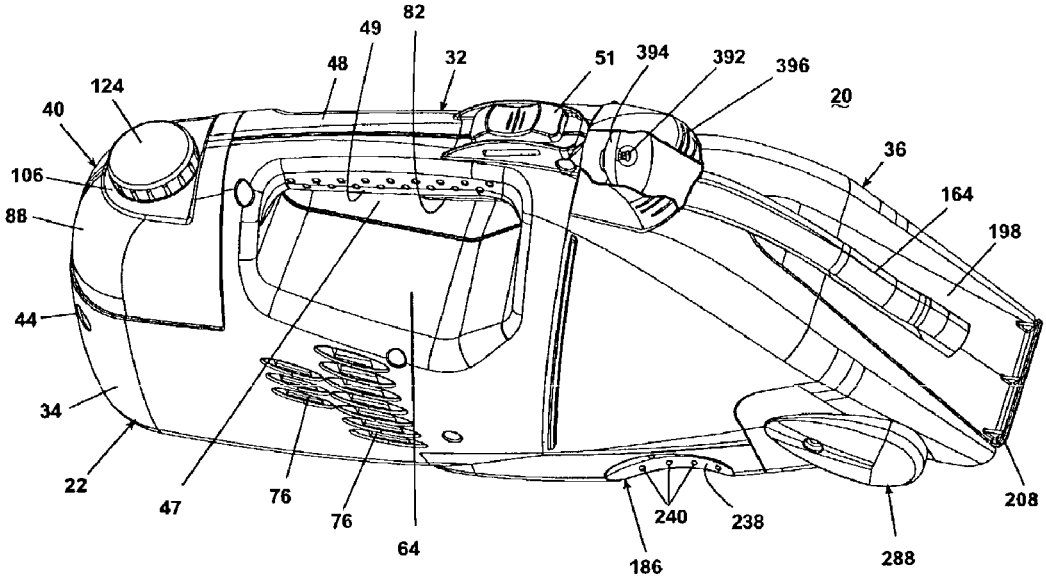
FIG. 33 is a perspective view of a further embodiment of the hand-held deep cleaner according to the invention with an illumination source.

Referring to FIG. 33, in a further embodiment of the portable hand-held deep cleaner of FIG. 1, an illumination system is provided. An incandescent lamp 392 is positioned in a reflectorized housing 394 at the top forward portion of the first air-liquid separator 36. The lamp 392 is selectively electrically connected to battery pack 52 through switch 50 located in the upper handle portion 48 of the housing halves 22, 24. The solution tube and transparent conduit 164 are located below the reflectorized housing 394. A transparent lens 396 covers housing 394 to protect lamp 392 from contamination and to provide an external surface for the cleaner 20. When activated, illumination from the lamp 392 is directed through the transparent lens 396 to an area forward of the deep cleaner to illuminate the surface being cleaned.

While various alternative embodiments have been described in FIGS. 17–33 with respect to the general embodiment of FIGS. 1–16, it will be understood that one, all, or various subcombinations of the features shown in FIGS. 17–33 can be added to the general embodiment of FIGS. 1–16 without departing from the scope of this invention.

Reasonable variation and modification are possible within the spirit of the foregoing specification and drawings without departing from the scope of the invention which is defined in the appended claims.

What is claimed is:

1. In a hand-held liquid extraction cleaner for cleaning a surface and comprising:

a housing forming a handle at an upper portion thereof for carrying the extraction cleaner;

a liquid extraction system mounted to the housing and including:

a suction nozzle;

an air-liquid separator integral with the housing and in fluid communication with the suction nozzle, for separating air from liquid and debris;

a recovery tank in fluid communication with the air-liquid separator for collecting recovered liquid and debris separated from air in the air-liquid separator;

a vacuum source in fluid communication with the suction nozzle and the air-liquid separator, whereby the vacuum source can draw liquid and debris through the suction nozzle and deposit them into the recovery tank; and a liquid dispensing system including:

a cleaning fluid supply tank; and a spray nozzle connected to the cleaning fluid supply tank for spraying cleaning fluid onto the surface to be cleaned;

the improvement comprising:

at least one agitator mounted to the air-liquid separator adjacent to the suction nozzle for rotation about an axis and for scrubbing the surface to be cleaned; and a motor carried by the housing and operably connected to the agitator to drive rotation of the agitator about the axis of rotation.

2. The liquid extraction cleaner according to claim 1 wherein the recovery tank is removably mounted to the air-liquid separator.

3. The liquid extraction cleaner according to claim 1 wherein air-liquid separator is mounted to a front portion of the housing adjacent to the suction nozzle.

4. The liquid extraction cleaner according to claim 1 wherein the suction nozzle is elongated and has a longitudinal axis, and the axis of rotation of the at least one agitator is parallel to the longitudinal axis of the suction nozzle.

5. The liquid extraction cleaner according to claim 1 wherein the motor is mounted to the air-liquid separator.

6. The liquid extraction cleaner according to claim 1 wherein the motor that drives the at least one agitator is operable independently of the vacuum source.

7. The liquid extraction cleaner according to claim 1 wherein the at least one agitator has more than two rows of bristles.

8. The liquid extraction cleaner according to claim 1 wherein the at least one agitator includes—two agitators rotatably mounted to the air-liquid separator.

9. The liquid extraction cleaner according to claim 8 wherein the two agitators are driven by the motor in opposite directions.

10. The liquid extraction cleaner according to claim 8 wherein the suction nozzle is elongated and has a longitudinal axis, and the axes of rotation of the agitators are parallel to the longitudinal axis of the suction nozzle.

11. The liquid extraction cleaner according to claim 8 wherein the motor that drives the agitators is operable independently of the vacuum source.

12. The liquid extraction cleaner according to claim 8 wherein the agitators are brushes and each of the brushes have at least two rows of bristles.

13. The liquid extraction cleaner according to claim 1 wherein the at least one agitator has a plurality of flexible paddles extending radially therefrom.

14. The liquid extraction cleaner according to claim 13 wherein the suction nozzle is elongated and has a longitudinal axis, and the axis of rotation of the agitator is parallel to the longitudinal axis of the suction nozzle.

15. The liquid extraction cleaner according to claim 13 wherein the motor that drives the roller is operable independently of the vacuum source.

16. The liquid extraction cleaner according to claim 1 wherein the agitator comprises two rollers rotatably mounted to the housing next to the suction nozzle, each of the rollers having a plurality of flexible paddles extending radially therefrom and rotatable in a direction opposite the other.

17. The liquid extraction cleaner according to claim 1 wherein the recovery tank comprises visual indicia to indicate a maximum capacity of recovered liquid and debris.

18. The liquid extraction cleaner according to claim 1 and further comprising a lamp assembly mounted to a front portion of the air-liquid separator and connected to a source of electrical energy for illuminating the surface to be cleaned.

19. A liquid extraction cleaner for cleaning a surface and having a housing forming a handle at an upper portion thereof for carrying the extraction cleaner, and comprising a liquid extraction system mounted on the housing and including:

an air-liquid separator at a front portion of the housing;

a suction nozzle fluidly connected to the air-liquid separator;

a vacuum source in communication with the air-liquid separator and the suction nozzle whereby the vacuum source can draw liquid and debris through the suction nozzle and deposit them in the air-liquid separator; and a liquid dispensing system mounted on the housing and including:

a cleaning fluid supply tank;

a spray nozzle connected to the cleaning fluid supply tank for delivery of cleaning fluid onto the surface to be cleaned;

the improvement which comprises:

a lamp assembly mounted to a front portion of the air-liquid separator and connected to a source of electrical energy for illuminating the surface to be cleaned.

* * * * *